US006905314B2

(12) United States Patent
Danby

(10) Patent No.: US 6,905,314 B2
(45) Date of Patent: Jun. 14, 2005

(54) PUMP HAVING FLEXIBLE LINER AND COMPOUNDING APPARATUS HAVING SUCH A PUMP

(75) Inventor: Hal C. Danby, Suffolk (GB)

(73) Assignee: Baxter International Inc., Deerfield, IL (US)

( * ) Notice: Subject to any disclaimer, the term of this patent is extended or adjusted under 35 U.S.C. 154(b) by 0 days.

(21) Appl. No.: 09/978,649

(22) Filed: Oct. 16, 2001

(65) Prior Publication Data

US 2003/0072652 A1 Apr. 17, 2003

(51) Int. Cl.[7] ..... F04B 35/00; F04B 43/06

(52) U.S. Cl. ..... 417/53; 417/393; 417/395; 417/479; 417/521; 222/105; 222/129

(58) Field of Search ..... 417/53, 384, 389, 417/392–395, 521, 478, 479, 533, 413; 222/105, 129, 130, 135, 144.5, 185.1, 214, 318, 325, 459; 604/131–133, 140–146, 403, 408, 251

(56) References Cited

U.S. PATENT DOCUMENTS

| | | | | |
|---|---|---|---|---|
| 2,791,324 A | | 5/1957 | Knoop et al. | |
| 2,872,081 A | | 2/1959 | Randall | |
| 3,007,416 A | * | 11/1961 | Childs | 417/383 |
| 3,144,976 A | | 8/1964 | Freshour | |
| 3,257,072 A | | 6/1966 | Reynolds | |
| 3,343,719 A | | 9/1967 | Kastamo et al. | |
| 3,435,990 A | | 4/1969 | Pike, Jr. | |
| 3,656,873 A | | 4/1972 | Schiff | |
| 3,677,444 A | * | 7/1972 | Merrill | 222/135 |

(Continued)

FOREIGN PATENT DOCUMENTS

| | | | |
|---|---|---|---|
| DE | 2131554 | A | 12/1972 |
| EP | 0 033 096 | A2 | 8/1981 |
| EP | 0 132 632 | A2 | 2/1985 |
| EP | 0 482 721 | B1 | 9/1995 |
| FR | 1386519 | A | 1/1965 |
| GB | 1 547 025 | | 6/1979 |
| GB | 2 098 963 | A | 5/1981 |
| GB | 2255073 | A | 10/1992 |
| JP | 2001/139040 | A | 5/2001 |
| WO | WO 81/02002 | A1 | 7/1981 |
| WO | WO 95/25459 | A1 | 9/1995 |
| WO | WO 97/33809 | A1 | 9/1997 |
| WO | WO 03/038770 | A2 | 5/2003 |

OTHER PUBLICATIONS

International Search Report for PCT/US 03/39243 dated Jun. 8, 2004.

International Search Report for PCT/US 03/16020 dated Sep. 19, 2003.

International Search Report for PCT/US 02/18631 dated Jul. 10, 2002.

International Search Report for PCT/US 02/27984 dated Dec. 13, 2002.

*Primary Examiner*—Charles G. Freay

(74) *Attorney, Agent, or Firm*—Joseph P. Reagen; Kurt F. James

(57) ABSTRACT

A pump has a flexible liner which is expanded and contracted by application of positive and negative fluid pressure for receiving and discharging fluent material. The liner is received in a rigid shell which defines the maximum volume received. In discharging fluent material, a vacuum is applied to one side of the liner, while applying pressure to the other side so the liner is collapsed against the rigid shell. The liner is arranged so as to be the only part of the pump which contacts the fluent material, and is replaceable to effect rapid and easy cleaning of the pump. The liner has multiple pump cells which can expand and contract for moving fluent material through the pump cell. The pump cells can be sized and arranged so that by selection of particular pump cells which receive the fluent material, precise volumes can be metered by the pump.

86 Claims, 11 Drawing Sheets

U.S. PATENT DOCUMENTS

| | | | | | |
|---|---|---|---|---|---|
| 3,689,204 | A | | 9/1972 | Prisk | |
| 3,768,704 | A | | 10/1973 | Beguin | |
| 3,790,029 | A | | 2/1974 | Ward | |
| 3,808,772 | A | | 5/1974 | Turtschan | |
| 3,814,547 | A | * | 6/1974 | Kitrilakis et al. | 417/383 |
| 3,878,992 | A | | 4/1975 | MacManus | |
| 3,913,734 | A | | 10/1975 | Siegel | |
| 3,955,901 | A | | 5/1976 | Hamilton | |
| 4,025,739 | A | | 5/1977 | Kull | |
| 4,047,844 | A | | 9/1977 | Robinson | |
| 4,086,653 | A | | 4/1978 | Gernes | |
| 4,158,530 | A | | 6/1979 | Bernstein | |
| 4,166,412 | A | | 9/1979 | Versteege | |
| 4,174,872 | A | | 11/1979 | Fessler | |
| 4,181,245 | A | | 1/1980 | Garrett et al. | |
| 4,220,259 | A | | 9/1980 | Lagneaux | |
| 4,228,926 | A | | 10/1980 | Gordon | |
| 4,237,881 | A | | 12/1980 | Beigler et al. | |
| 4,265,601 | A | | 5/1981 | Mandroian | |
| 4,273,121 | A | | 6/1981 | Jassawalla | |
| 4,301,926 | A | | 11/1981 | Chung | |
| 4,303,376 | A | | 12/1981 | Siekmann | |
| 4,334,640 | A | | 6/1982 | van Overbruggen et al. | |
| 4,348,280 | A | | 9/1982 | George et al. | |
| 4,368,765 | A | | 1/1983 | Larkin et al. | |
| 4,375,346 | A | | 3/1983 | Kraus et al. | |
| 4,389,436 | A | | 6/1983 | Weiner | |
| 4,401,239 | A | | 8/1983 | Thomassen | |
| 4,421,506 | A | | 12/1983 | Danby et al. | |
| 4,430,048 | A | | 2/1984 | Fritsch | |
| 4,477,054 | A | | 10/1984 | Danby et al. | |
| 4,479,761 | A | | 10/1984 | Bilstad et al. | |
| 4,482,299 | A | | 11/1984 | Eulass | |
| 4,513,885 | A | | 4/1985 | Hogan | |
| 4,515,589 | A | | 5/1985 | Austin et al. | |
| 4,537,387 | A | | 8/1985 | Danby et al. | |
| 4,548,023 | A | | 10/1985 | Danby et al. | |
| 4,552,512 | A | | 11/1985 | Gallup et al. | |
| 4,552,552 | A | | 11/1985 | Polaschegg et al. | |
| D283,225 | S | | 4/1986 | Canvasser | |
| 4,618,399 | A | | 10/1986 | Li | |
| 4,624,663 | A | | 11/1986 | Danby et al. | |
| 4,634,430 | A | | 1/1987 | Polaschegg et al. | |
| 4,639,251 | A | | 1/1987 | Kirkland | |
| 4,642,098 | A | | 2/1987 | Lundquist | |
| 4,648,810 | A | | 3/1987 | Schippers et al. | |
| 4,651,862 | A | | 3/1987 | Greenfield, Jr. | |
| 4,686,125 | A | | 8/1987 | Johnston et al. | |
| 4,708,266 | A | | 11/1987 | Rudick | |
| 4,717,047 | A | | 1/1988 | van Overbruggen et al. | |
| 4,717,117 | A | | 1/1988 | Cook | |
| 4,718,778 | A | | 1/1988 | Ichikawa | |
| 4,741,461 | A | | 5/1988 | Williamson et al. | |
| 4,753,370 | A | | 6/1988 | Rudick | |
| 4,765,512 | A | | 8/1988 | Bull, Jr. | |
| 4,768,547 | A | | 9/1988 | Danby et al. | |
| 4,778,451 | A | | 10/1988 | Kamen | |
| 4,804,118 | A | | 2/1989 | Mullen et al. | |
| 4,808,161 | A | | 2/1989 | Kamen | |
| 4,808,346 | A | | 2/1989 | Strenger | |
| 4,816,019 | A | | 3/1989 | Kamen | |
| 4,818,186 | A | | 4/1989 | Pastrone et al. | |
| 4,826,482 | A | | 5/1989 | Kamen | |
| 4,828,545 | A | | 5/1989 | Epstein et al. | |
| 4,830,586 | A | | 5/1989 | Herter et al. | |
| 4,848,722 | A | | 7/1989 | Webster | |
| 4,857,055 | A | | 8/1989 | Wang | |
| 4,860,923 | A | | 8/1989 | Kirschner et al. | |
| 4,872,813 | A | | 10/1989 | Gorton et al. | |
| 4,886,432 | A | | 12/1989 | Kimberlin | |
| 4,898,303 | A | | 2/1990 | Large et al. | |
| 4,918,907 | A | | 4/1990 | Roach et al. | |
| 4,942,735 | A | | 7/1990 | Mushika et al. | |
| 4,976,162 | A | | 12/1990 | Kamen | |
| 4,983,102 | A | | 1/1991 | Swain | |
| 4,997,661 | A | | 3/1991 | Kromer et al. | |
| 5,000,351 | A | | 3/1991 | Rudick | |
| 5,002,471 | A | | 3/1991 | Perlov | |
| 5,006,050 | A | | 4/1991 | Cooke et al. | |
| 5,033,651 | A | | 7/1991 | Whigham et al. | |
| 5,080,652 | A | | 1/1992 | Sancoff et al. | |
| 5,082,143 | A | | 1/1992 | Schramm, Jr. | |
| 5,088,515 | A | | 2/1992 | Kamen | |
| 5,090,963 | A | * | 2/1992 | Gross et al. | 604/132 |
| 5,096,092 | A | | 3/1992 | Devine | |
| 5,097,989 | A | | 3/1992 | Nakayama et al. | |
| 5,105,983 | A | | 4/1992 | Sancoff et al. | |
| RE33,943 | E | | 6/1992 | Arzberger et al. | |
| 5,135,485 | A | | 8/1992 | Cohen et al. | |
| 5,151,019 | A | | 9/1992 | Danby et al. | |
| 5,193,990 | A | | 3/1993 | Kamen et al. | |
| 5,199,852 | A | | 4/1993 | Danby | |
| 5,230,566 | A | | 7/1993 | Jackson et al. | |
| D338,891 | S | | 8/1993 | Folk | |
| 5,242,083 | A | | 9/1993 | Christine et al. | |
| 5,249,706 | A | | 10/1993 | Szabo | |
| 5,265,518 | A | | 11/1993 | Reese et al. | |
| 5,284,481 | A | | 2/1994 | Soika et al. | |
| 5,302,088 | A | | 4/1994 | Gronski et al. | |
| 5,306,257 | A | * | 4/1994 | Zdeb | 604/131 |
| 5,332,372 | A | | 7/1994 | Reynolds | |
| 5,341,957 | A | | 8/1994 | Sizemore | |
| 5,344,292 | A | | 9/1994 | Rabenau et al. | |
| 5,350,357 | A | | 9/1994 | Kamen et al. | |
| 5,353,963 | A | | 10/1994 | Gorski et al. | |
| 5,356,039 | A | | 10/1994 | Christine et al. | |
| 5,361,943 | A | | 11/1994 | Du | |
| 5,369,999 | A | | 12/1994 | Yoshida | |
| 5,385,540 | A | | 1/1995 | Abbott et al. | |
| 5,409,355 | A | | 4/1995 | Brooke | |
| 5,429,485 | A | | 7/1995 | Dodge | |
| 5,458,468 | A | | 10/1995 | Ye et al. | |
| 5,465,619 | A | | 11/1995 | Sotack et al. | |
| 5,476,368 | A | | 12/1995 | Rabenau et al. | |
| 5,487,649 | A | | 1/1996 | Dorsey, III et al. | |
| 5,507,415 | A | | 4/1996 | Sizemore | |
| 5,542,919 | A | | 8/1996 | Simon et al. | |
| 5,578,001 | A | | 11/1996 | Shah | |
| 5,584,811 | A | | 12/1996 | Ross et al. | |
| 5,588,816 | A | | 12/1996 | Abbott et al. | |
| 5,593,290 | A | | 1/1997 | Greisch et al. | |
| 5,597,093 | A | | 1/1997 | Lee | |
| 5,609,572 | A | | 3/1997 | Lang | |
| 5,613,835 | A | | 3/1997 | Tyner | |
| 5,620,420 | A | | 4/1997 | Kriesel | |
| 5,649,910 | A | | 7/1997 | Kriesel et al. | |
| 5,656,032 | A | | 8/1997 | Kriesel et al. | |
| 5,656,033 | A | | 8/1997 | Atkinson | |
| 5,660,477 | A | | 8/1997 | Ichikawa | |
| 5,669,764 | A | | 9/1997 | Behringer et al. | |
| 5,673,820 | A | | 10/1997 | Green et al. | |
| 5,682,726 | A | | 11/1997 | Green et al. | |
| 5,690,253 | A | | 11/1997 | LaFleur | |
| 5,693,018 | A | | 12/1997 | Kriesel et al. | |
| 5,693,019 | A | | 12/1997 | Kriesel | |
| 5,697,525 | A | | 12/1997 | O'Reilly et al. | |
| 5,700,245 | A | | 12/1997 | Sancoff et al. | |
| 5,716,343 | A | | 2/1998 | Kriesel et al. | |
| 5,720,728 | A | * | 2/1998 | Ford | 604/131 |
| 5,722,957 | A | | 3/1998 | Steinbach | |
| 5,728,086 | A | | 3/1998 | Niedospial, Jr. | |

5,730,165 A 3/1998 Philipp
5,735,818 A 4/1998 Kriesel et al.
5,749,854 A 5/1998 Shen
5,766,150 A 6/1998 Langkau
5,785,688 A 7/1998 Joshi et al.
5,803,317 A 9/1998 Wheeler
5,816,779 A 10/1998 Lawless et al.
5,836,482 A 11/1998 Ophardt et al.
5,836,908 A 11/1998 Beden et al.
5,842,841 A 12/1998 Danby et al.
5,853,247 A 12/1998 Shroyer
5,857,951 A 1/1999 Ichikawa
5,921,951 A 7/1999 Morris
5,938,634 A 8/1999 Packard
5,964,583 A 10/1999 Danby
6,003,733 A 12/1999 Wheeler
6,016,935 A 1/2000 Huegerich et al.
6,024,252 A 2/2000 Clyde
6,036,056 A 3/2000 Lee et al.
6,039,214 A 3/2000 Hewett
6,062,425 A 5/2000 Brown et al.
6,092,695 A 7/2000 Loeffler
6,096,358 A 8/2000 Murdick et al.
6,098,524 A 8/2000 Reese
6,116,460 A 9/2000 Kim et al.
6,126,403 A 10/2000 Yamada
6,139,531 A 10/2000 Danby
6,142,340 A 11/2000 Watanabe et al.
6,158,484 A 12/2000 Greenlee
6,165,154 A 12/2000 Gray et al.
6,167,683 B1 1/2001 Wong
6,173,862 B1 1/2001 Buca et al.
6,186,361 B1 2/2001 Teetsel, III
6,189,736 B1 2/2001 Phallen et al.
6,213,738 B1 4/2001 Danby et al.
6,250,506 B1 6/2001 Geiger et al.
6,253,968 B1 7/2001 Van Dijk et al.
6,257,844 B1 7/2001 Stern
6,296,450 B1 10/2001 Westberg et al.
6,332,564 B2 12/2001 Ichikawa
6,345,734 B2 2/2002 Schalow et al.
6,382,470 B1 5/2002 Hu et al.
6,398,760 B1 6/2002 Danby
6,416,293 B1 7/2002 Bouchard et al.
6,419,121 B1 7/2002 Gutierrez
6,428,518 B1 8/2002 Brengle et al.
6,505,758 B2 1/2003 Black et al.
6,516,997 B1 2/2003 Tanazawa et al.
6,527,518 B2 3/2003 Ostrowski
6,536,188 B1 3/2003 Taggart
2003/0017066 A1 1/2003 Danby et al.

* cited by examiner

PUMP HAVING FLEXIBLE LINER AND COMPOUNDING APPARATUS HAVING SUCH A PUMP

BACKGROUND OF THE INVENTION

This invention relates generally to pumps which meter predetermined volumes and more particularly to such a pump employing a flexible liner.

Pumps are often used in applications where it is important to keep the surfaces contacting the fluent material being pumped clean. For instance, where the fluent material is a food additive for a food product, it is imperative that surfaces contacting the material be maintained in an aseptic condition. Accordingly, the parts of the pump which contact the food are made of materials (e.g., stainless steel) which are highly resistant to corrosion and can be cleaned. However, such materials are expensive and significantly increase the cost of the pump. The pump must be periodically shut down to clean surfaces which handle the food product. Cleaning may also involve continuing to operate the pump while flushing with a cleaning liquid. In any event, the pump is not available for production operation while cleaning is taking place. Many fluent food products are prone to leave residue or debris as they are handled, which cause the pump to become unsanitary. Although necessary, it is inefficient to stop the pump frequently for cleaning and this increases the cost of manufacturing the product.

Even when it is not necessary to maintain aseptic conditions, it frequently is important that a build up of the fluent material be avoided. As another example, a pump may be used in mixing paint. Operation of the pump can be hindered by a build up of paint in the pump. Moreover, color quality can be affected where paints are mixed by a build up of paint. Accordingly, it is necessary to clean the apparatus frequently.

Pumps used in situations like those described herein often are called upon to meter fluent materials in precise quantities. Such pumps also have application in the medical field for administration of, for instance, medicaments. It is known to use membrane pumps to administer precise quantities, particularly where small amounts of fluent material are metered. Membrane pumps typically have one or more cavities in a rigid base which are covered by a flexible membrane. A force can be applied, such as by fluid pressure, to the membrane to move it into the cavity to pump fluent material from the cavity. The fluent material still must come into contact with the rigid base in operation of the membrane pumps.

SUMMARY OF THE INVENTION

Among the several objects and features of the present invention may be noted the provision of a pump which facilitates maintenance of sanitary conditions; the provision of such a pump requires minimal effort to clean; the provision of such a pump which contacts the fluent material only with a disposable liner; the provision of such a pump which is useful for dispensing food products; the provision of such a pump which can meter fluent material in precise quantities; the provision of such a pump which is capable of mixing component fluent materials; and the provision of a dispensing apparatus including such a pump.

Further among the several objects and features of the present invention may be noted the provision of a method of operating a pump which achieves a high level of accuracy; the provision of such a method which reduces undesired movement of pump components; and the provision of such a method which can precisely mix various fluent material components.

In one aspect of the invention, a pump for pumping a fluent material comprises a liner including opposing walls of flexible material defining at least one pump cell, an inlet and an outlet. The pump cell is sized and shaped for receiving a quantity of the fluent material and is expandable for receiving fluent material and contractible for discharging fluent material. A rigid shell adapted to receive and substantially enclose at least the pump cell of the liner is formed with at least one receptacle therein to receive in close fitting relation the pump cell. The one receptacle is adapted for connection to a source of pressurized gas and for connection to a vacuum source for selectively applying a vacuum pressure and a positive pressure to the cell to selectively expand and collapse the cell for drawing fluent material into the pump cell and expelling the fluent material from the pump cell. Valves associated with the rigid shell and disposed for pinching engagement with the liner adjacent to the pump cell are capable of selectively blocking and opening fluid communication of the pump cell thereby to pump the fluent material.

In another aspect of the present invention, apparatus for dispensing a customized drink mixture comprises a dispensing outlet for dispensing the drink mixture to a container, a first pump for pumping a base liquid of the drink mixture from a source to the dispensing outlet, and a second pump for metering selected quantities of admixtures to the base liquid for forming with the base liquid the drink mixture in the container. The second pump comprises a liner including opposing walls of flexible material selectively joined together to define at least two pump cells sized and shaped for receiving a quantity of one of the admixtures. The liner farther includes inlets and at least one outlet in communication with the pump cell so that admixture passes through the pump contacting only the liner. A rigid shell adapted to receive and substantially enclose at least the pump cell of the liner is formed with receptacles therein to receive in close fitting relation the pump cells. The receptacles are adapted for connection to a source of pressurized gas and for connection to a vacuum source for selectively applying a vacuum pressure and a positive pressure to the cell to selectively expand and collapse the cell for drawing fluent material into the pump cell and expelling the fluent material from the pump cell. Valves associated with the rigid shell and disposed for pinching engagement with the liner adjacent to the pump cells selectively block and open fluid communication of the pump cells with the inlets and the outlet, thereby to pump the admixture.

In still another aspect of the present invention, a pump for metering a fluent material comprises a pump cell having flexible walls expandable between a fill configuration in which the walls enclose a first volume for receiving fluent material into the pump cell and a discharge configuration in which the walls enclose substantially no volume for discharging fluent material from the pump cell. A shell defining a space therein adapted to receive the pump cell for substantially enclosing the pump shell communicates with a pressure source for applying positive fluid pressure in the space and a vacuum source adapted for fluid communication with the shell space for applying vacuum pressure to the shell space. A control for the pressure source and the vacuum source is operable to first apply a vacuum pressure to the shell space for expanding the pump cell to the fill configuration for receiving fluent material into the pump cell, then to apply both a vacuum pressure and a positive fluid pressure for drawing one of the walls of the pump cell against the shell and pressing another of the walls of the pump cell against said one wall for moving the pump cell to the discharge configuration for discharging the fluent material.

In a further aspect of the invention, a method of operating a pump including a flexible pump cell expandable to define a volume and contractible to collapse the volume comprises the step of receiving fluent material into the pump cell by creating a vacuum around the pump cell to expand the pump cell. Fluent material is discharged from the pump cell by applying a vacuum pressure generally on one side of the pump cell while applying positive pressure to another side of the pump cell for collapsing said other side of the pump cell against said one side to discharge fluent material from the pump cell.

In yet a further aspect of the present invention, a pump for metering fluent material having shell adapted to receive a liner including opposed flexible walls. The liner comprises a pump cell defined by said opposed flexible walls and having an inlet opening and an outlet opening. The pump cell is deflectable to a first position defining a first volume corresponding to a volume defined by said shell and to a second position defining a second volume less than said first volume by action of a fluid on said cell outside said opposed flexible walls. A change from said first volume to said second volume pumps said fluent material contained interior to said cell.

In a still further aspect of the present invention, compounding apparatus for selectively combining components and dispensing admixtures, the compounding apparatus comprises a liner of including opposing walls of flexible material at least partially free of connection to permit motion toward and away from each other. The liner includes an inlet for each component to be compounded and at least one outlet. A shell having multiple receptacles formed therein is adapted to receive the liner with portions of the liner in registration with corresponding receptacles. The wall portions in registration with the receptacles defining pump cells expandable to receive a volume of at least one of the components at a time into the pump cell and collapsible to discharge the component from the pump cell. A pressure control system in fluid communication with the receptacles selectively affects fluid pressure in the receptacle around the pump cells to cause expansion and contraction of the pump cells for receiving and discharging the components to form the admixture.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
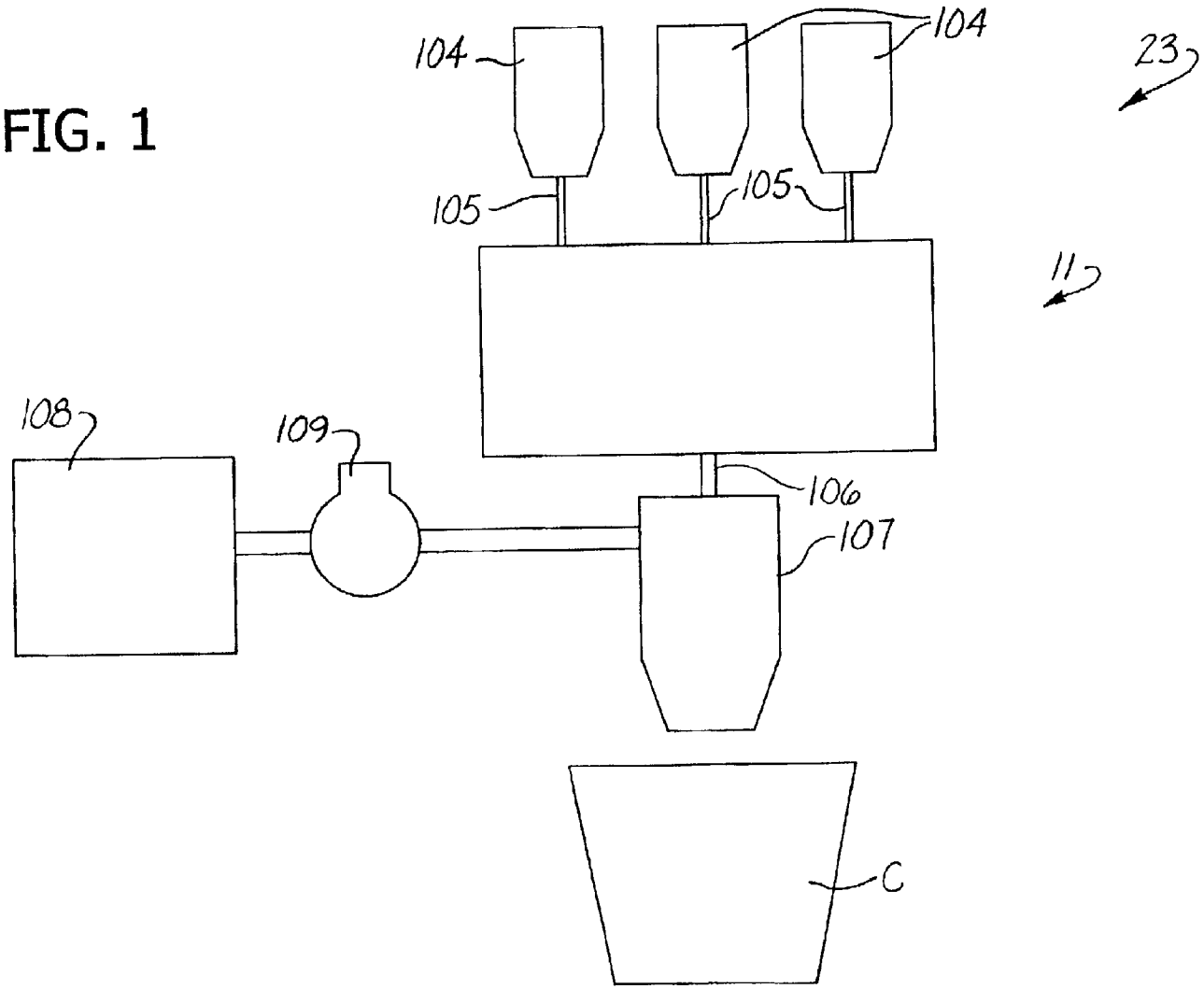
FIG. 1 is a schematic of a drink dispensing apparatus of the present invention.
Figure 2:
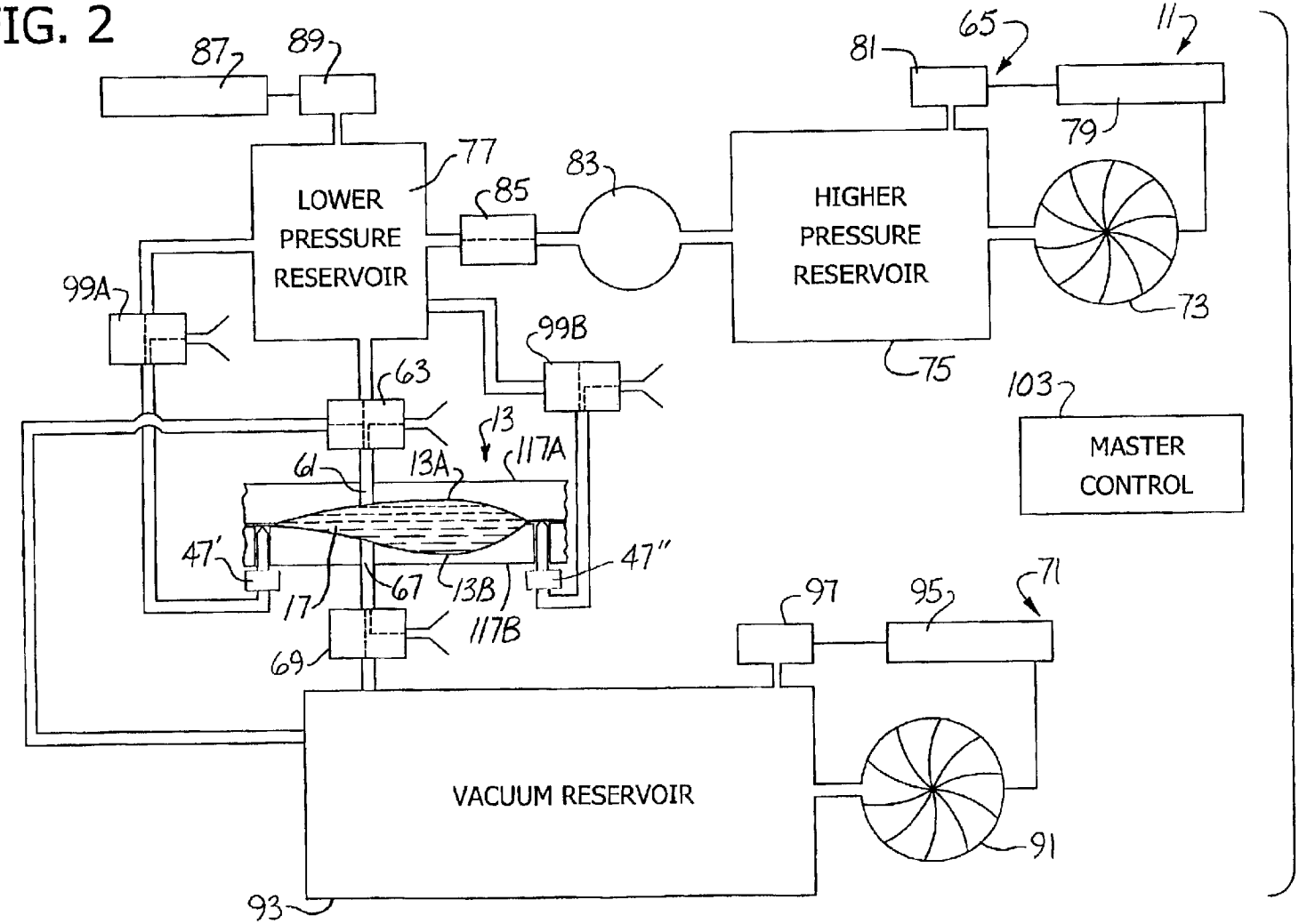
FIG. 2 is a schematic of a pump of the present invention.
Figure 6:
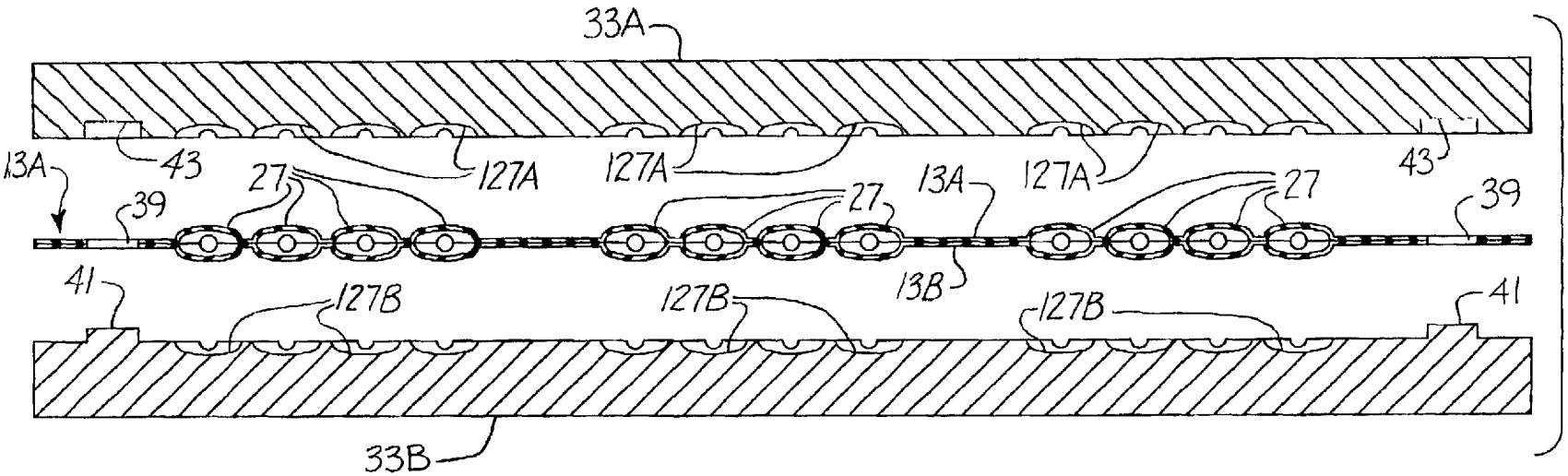
FIG. 6 is a cross section of the pump with halves of the pump shell and the pump liner exploded.

Referring now to the drawings and in particular to FIG. 2, a pump 11 constructed according to the principles of the present invention is shown to comprise a liner 13 made of a limp, flexible material, such as an appropriate polymer, including without limitation polyvinyl chloride, polyolefin, polymer laminates and polymer alloys. In a preferred embodiment, the liner 13 comprises two sheets of the material (designated 13A and 13B, respectively) in face-to-face relation which are joined together at their peripheral edge margins as by welding, leaving a weld seam around the peripheral edge (see FIGS. 4 and 6). The sheets 13A, 13B may be secured together in any other suitable manner, such as by adhesive or mechanical fasteners. The liner may be formed with a single sheet folded over and joined to itself, or otherwise so as to form a thin enclosure of flexible material capable of receiving and discharging fluent material. The sheets 13A, 13B are also welded together to define multiple pump cells 17, manifold pump cells 19 and a header pump cell 21 in the interior of the liner 13. All of these may be generally considered to be "pump cells" in that they are expandable for receiving fluent material and contractible for discharging the fluent material in operation of the pump 11. "Fluent material" is used to convey that a pump of the present invention can be used for gases and liquids, but it is also envisioned that the pump could be used with very finely divided solids. However in the preferred embodiments described herein, the fluent material is a liquid and so the term "liquid" will be used herein without limitation as to the type of material which can be acted upon by a pump of the present invention. As will be described more fully hereinafter, the pump 11 has application for use in a drink dispenser, generally indicated at 23, capable of making a drink with different selected mixes of flavorings, as schematically illustrated in FIG. 1.

Figure 4:
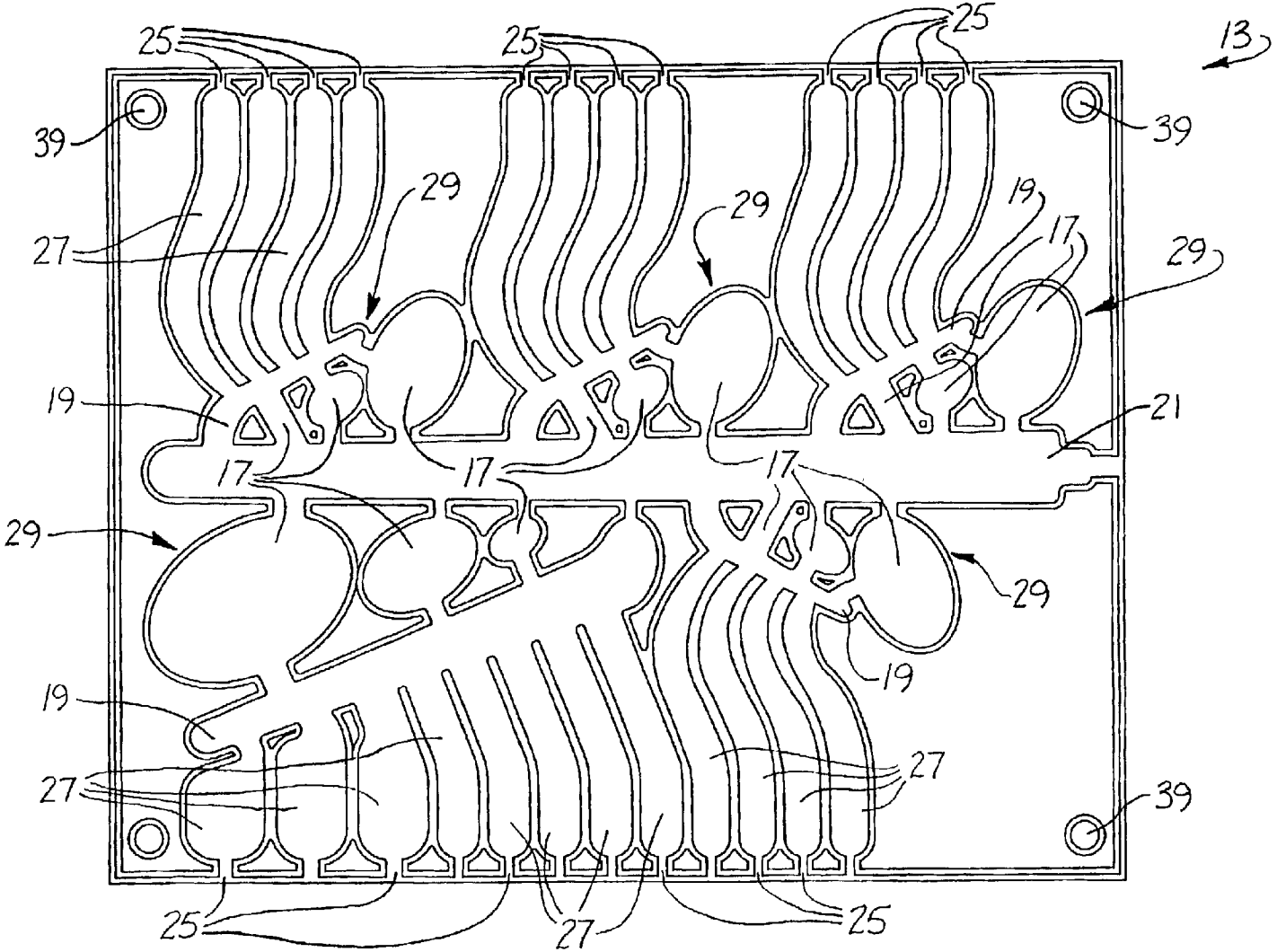
FIG. 4 is a plan of a liner of flexible material of the pump of FIG. 3.

The sheets 13A, 13B of the liner 13 are also welded together so as to form inlets 25 and passages 27 for receiving liquid into the liner. The liner 13 illustrated in FIG. 4 is particularly configured for delivering variable and precise volumes to form a mixture. The pump cells 17 and manifold pump cells 19 are arranged in five groups (designated generally at 29) each including three pump cells of differing size and volume and a manifold pump cell. The pump cells 17 and manifold pump cell 19 of each group 29 communicate with the header pump cell 21 extending laterally of the liner 13 and having an outlet, constituting in this embodiment the outlet of the pump 11. The manifold pump cell 19 of each group 29 communicates with the passages 27 from the inlets, with each pump cell 17 in the group and also with the manifold pump cells 19. Liquid from the manifold pump cell 19 can enter either one of the pump cells 17 or the manifold pump cells 19, as will be described hereinafter. Although the pump of the preferred embodiment is illustrated as having multiple cells (17, 19, 21) and passages 27, it is to be understood that a pump (not shown) could have any number of cells, including only a single cell, without departing from the scope of the present invention. Moreover, the passages do not have to be expandible and collapsible for pumping fluid like passages 27, but may be of a fixed volume, in the manner of the inlets 25. The number and configuration of the cells and passages will be dictated by the particular application of the pump.

Figure 3:
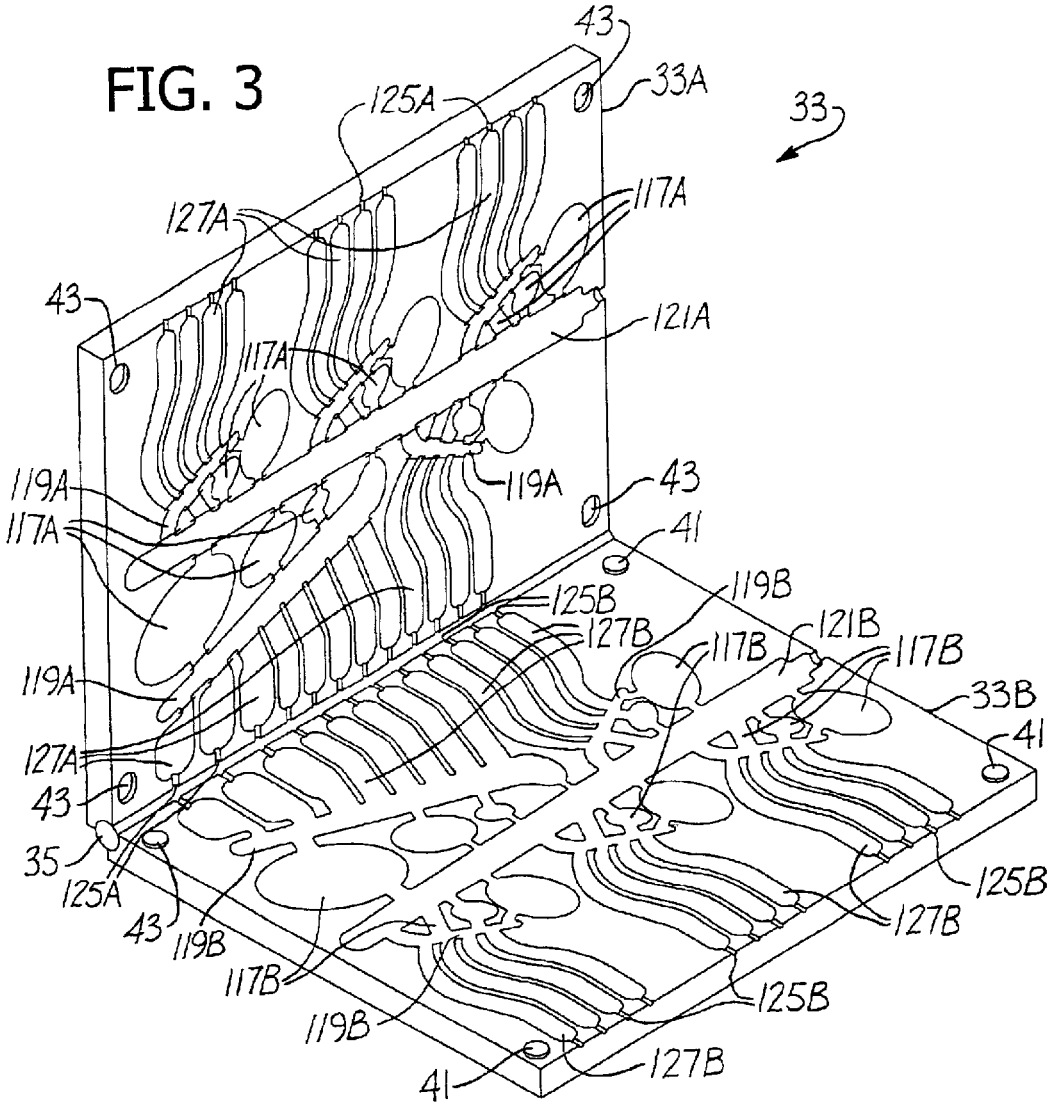
FIG. 3 is a perspective of a shell of a pump of the present invention in the form of a compounding apparatus.

Referring now to FIG. 3, the liner 13 is received between an upper half 33A and lower half 33B of a rigid shell (generally indicated at 33). In the preferred embodiment, the material is a metal, but could be another rigid material such as a polymeric material. The shell 33 may have fewer or greater number of component parts. Moreover, the terms "upper" and "lower" have been chosen for convenience, as the component parts of the shell 33 may assume other relative positions. As shown, the upper and lower halves 33A, 33B are connected together by a hinge 35 for ease of opening and closing the shell 33 to remove, adjust or replace the liner 13 between the shell halves. The halves 33A, 33B need not be permanently connected. It will be readily appreciated that each shell half (33A, 33B) is formed with cooperating receptacle members arranged identically to the arrangement of pump cells 17, the manifold pump cells 19, the header pump cell 21, the inlets 25 and the passages 27 of the liner 13. The receptacle members are designated by the same reference number as the part of the liner 13 which they receive, but with the prefix "1 " and the suffix "A" or "B" indicating their association with the upper shell half 33A or lower shell half 33B (e.g., 117A for the receptacle member receiving the pump cell 17 in the upper shell half 33A).

Figure 5:
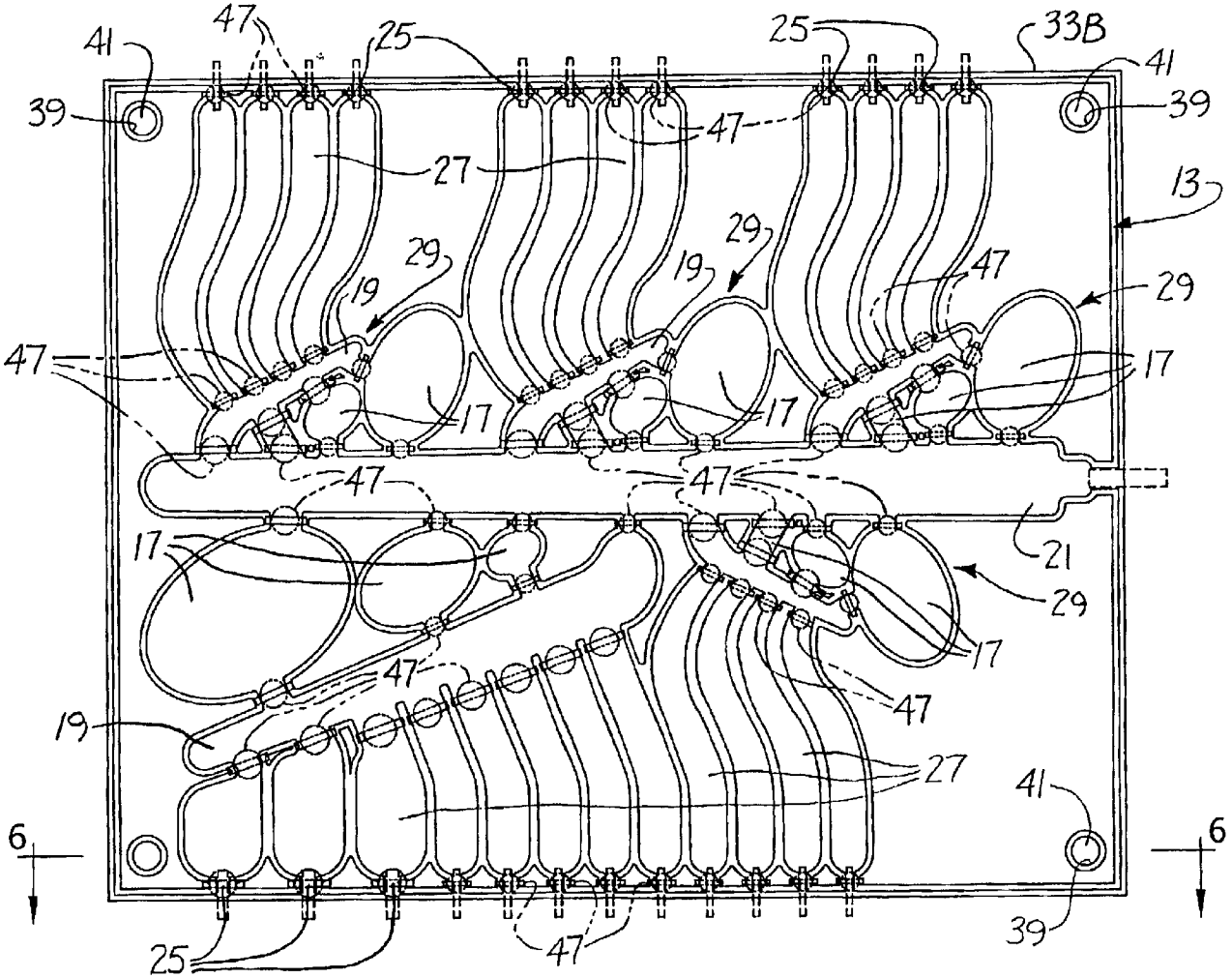
FIG. 5 is a plan of a lower half of the pump shell with the liner received therein and schematically illustrating valves.

The receptacle members (117A, 117B, 119A, 119B, 121A, 121B, 125A, 125B, 127A, 127B) of the upper and lower halves 33A, 33B are aligned when the shell 33 is closed to define receptacles having a shape closely corresponding to the shape of one of the pump cells 17, manifold pump cells 19 or of the header pump cell 21 for receiving the one pump cell, manifold pump cell or the header pump cell. Engagement of the shell halves 33A, 33B with the liner 13 should be sufficiently firm to produce a fluid tight seal of each receptacle formed for the mating receptacle members (117A et seq.), for reasons which will become apparent. It is envisioned that the seal could be sufficiently tight as to omit the necessity of preforming the welded seal around the peripheral edge, the pump cells 17, manifold pump cells 19, header pump cell 21, the inlets 25 and the passages 27. The liner 13 has a hole 39 at each of its four comers which is received on a respective stud 41 on the lower half 33B of the shell 33 to register the liner with the lower shell half 33B so that the pump cells 17, manifold pump cells 19 and header pump cell 21 are received in their corresponding receptacle members. Apertures 43 in the upper shell half 33A receive the studs 41 so that flat faces of the upper and lower halves 33A, 33B surrounding the receptacle members (117A et seq.) are parallel when closed. The apertures 43 are elongated so that they may receive the studs 41 as the upper shell half 33A pivots down to the closed position of the shell 33. The liner 13 on the lower shell half 33B is illustrated in FIG. 5.

Figure 7:
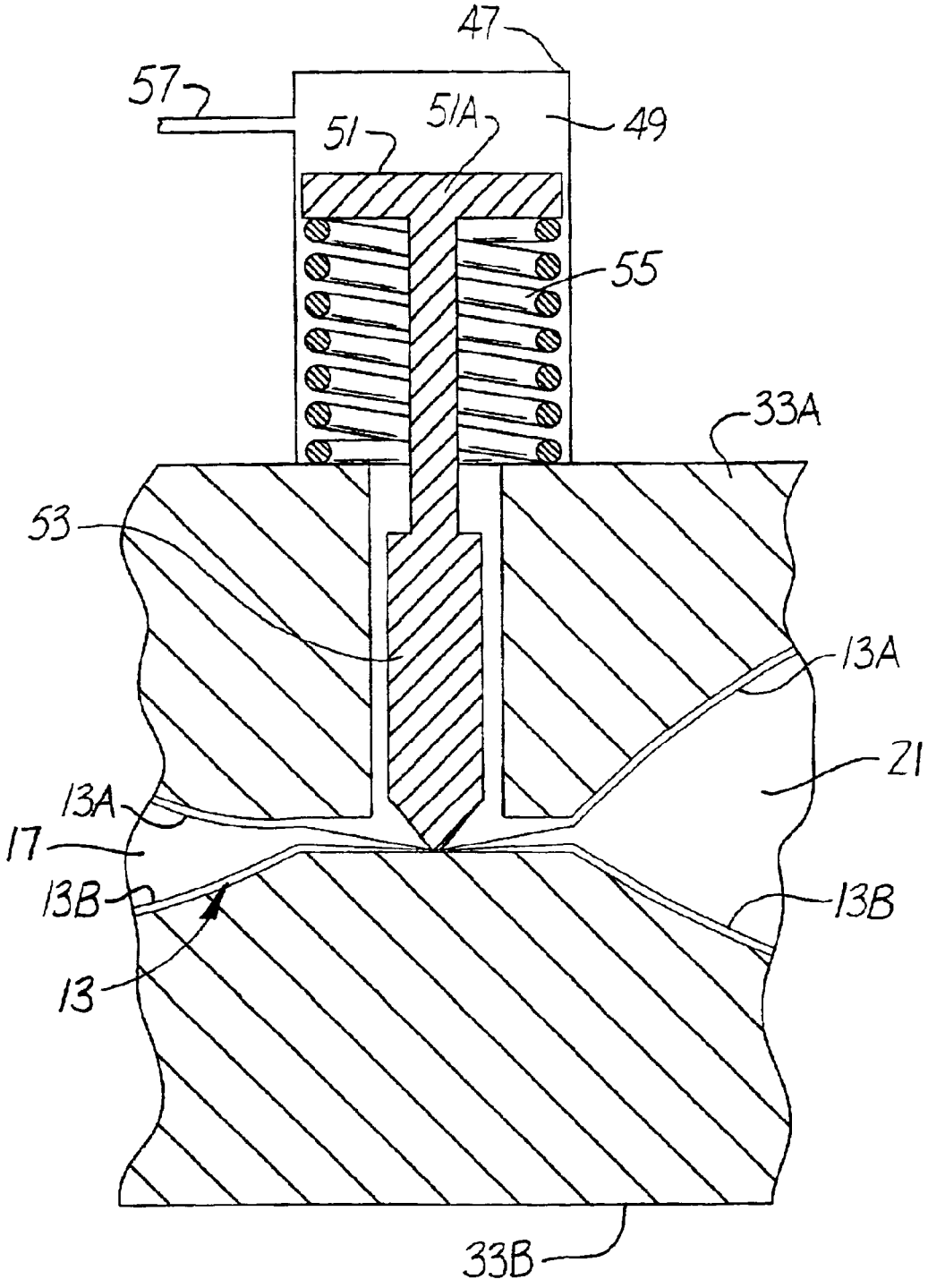
FIG. 7 is a schematic of a pinch valve of the pump.

The upper shell half 33A mounts a plurality of pinch valves 47 operable to open and close communication of the pump cells 17, manifold pump cells 19, header pump cell 21 and passages 27 as needed for operation. One of the pinch valves 47 is shown in FIG. 7 to comprise a cylinder 49 and a piston 51 having a head 51A slidingly received in the cylinder. The free end of the piston 51 outside the cylinder mounts a wedge 53 arranged to bear down against the liner 13 to bring the opposing walls (i.e., the interior surfaces of the liner sheets 13A, 13B) of the liner into sealing engagement for pinching off the liner to prevent fluid flow past the valve 47. The lower shell half 33B and the wedge 53 are shaped in a complementary manner so as to have a close fitting relationship when the pinch valve 47 is actuated to facilitate a tight closure. As illustrated, a spring 55 in the cylinder 49 engages one side of the piston head 51A and biases the piston 51 to a retracted position into the cylinder such that the wedge 53 does not pinch off the liner 13 and fluid may flow through the liner past the valve. Air under pressure may be received through an inlet 57 in the cylinder 49 on the opposite side of the piston head 51A from the spring 55 to force the head down against the bias of the spring to extend the piston for pinching off the liner 13. However, the pinch valve 47 may be actuated other than pneumatically (e.g., electrically) without departing from the scope of the present invention. Moreover, the sheets 13A, 13B could be forced together such as by application of air pressure directly to the sheets or by magnet attraction, without the use of a separate mechanical valve. It is to be understood that the term "valve" as used herein is intended to encompass arrangements which use air pressure or magnetic force to close the liner. The valves 47 may be actuated independently, in sets or simultaneously as needed for operation of the pump 11 in a particular application.

Referring again to FIG. 2, the upper shell half 33A further includes a first port 61 connected by a valve 63 to a source of pressurized air (or other gas) indicated generally at 65. The lower shell half 33B includes a second port 67 connected by a valve 69 to a vacuum source indicated generally at 71. Valve 63 is also capable of connecting the first port 61 to the vacuum source 71. The locations of the first port 61 and second port 67 could be reversed. The pressure source 65 includes a first compressor 73, a higher pressure reservoir 75 and a lower pressure reservoir 77. The first compressor 73 is operated by a first compressor control 79 which receives a signal from a first pressure transducer 81 indicating the pressure of the air in the higher pressure reservoir 75 for operating to keep the air pressure in the higher at a selected value. The higher pressure reservoir 75 is connected via a pressure regulator 83 and a valve 85 to the lower pressure reservoir 77 containing air at an elevated pressure, but lower than that of the higher pressure reservoir. The valve 85 is operated by a control 87 according to the air pressure in the lower pressure reservoir 77 detected by a second pressure transducer 89 to open to allow air to enter the lower pressure reservoir for maintaining a predetermined air pressure in the reservoir. The pressure regulator 83 controls the pressure of the air entering the lower pressure reservoir 77 from the higher pressure reservoir 75 to stabilize the pressure in the lower pressure reservoir. The vacuum source 71 includes a second compressor 91 and a vacuum reservoir 93. The second compressor 91 is operated by a second compressor control 95 which receives a signal from a third pressure transducer 97 to maintain a substantially constant vacuum pressure in the lower pressure reservoir 93.

Figure 8A:
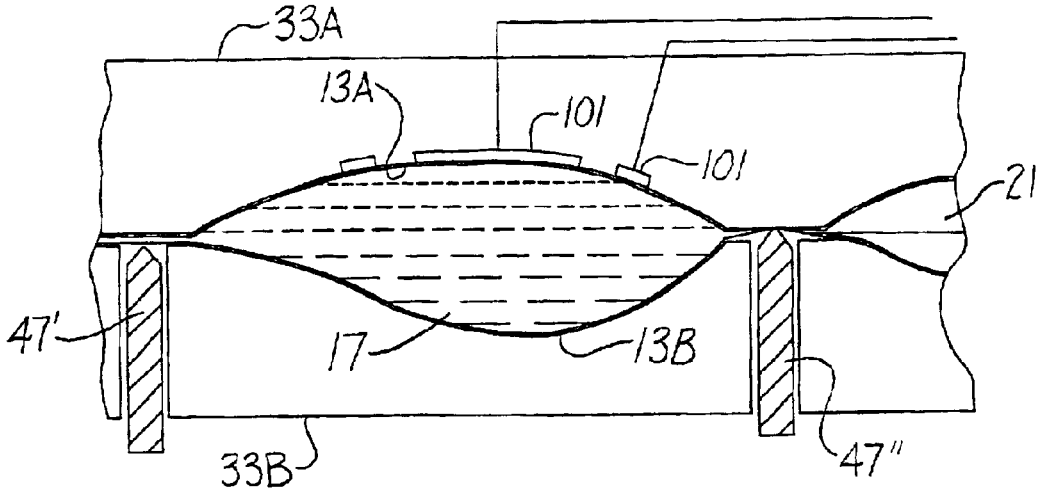
FIGS. 8A–8D are fragmentary cross sections of the pump showing a single pump cell and illustrating the operation of the pump.

The base operation of the pump 11 for a single pump cell 17 (as illustrated in FIG. 2 and FIGS. 8A–8D) relies on the liner 13 extending between the receptacle members 117A, 117B so that although the receptacle members are closely adjacent to define the pump receptacles, they are fluidically separated from each other. In other words, the liner 13 and each receptacle member 117A, 117B define an independently sealed chamber. First, the valves 63 and 69 are actuated so that the receptacle member 117A of the upper shell half 33A and the receptacle member 117B of the lower shell half 33B are both exposed to vacuum pressure from the vacuum reservoir 93. For purposes the of this description the specific pinch valves will be designated as 47' and 47" to distinguish the upstream and downstream pinch valves. The pinch valves 47', 47" are operated by valves, designated 99A and 99B, respectively, which connect the cylinders 49 of the valves to the lower pressure reservoir 77 of the pressure source 65. At the same time the pinch valve 47' on the inlet side of the pump cell 17 is opened and the pinch valve 47" on the outlet side of the pump cell is closed. The valves 63 and 69 are operated to connect the upper and lower receptacle members 117A, 117B to the vacuum reservoir 93 of the vacuum source 71. The pump cell 17 expands by separation of the walls (i.e., the sheets 13A, 13B) of the liner 13 at the pump cell to create a volume and draw liquid into the pump cell (FIG. 8A). The walls 13A, 13B of the liner 13 are expanded substantially against the shell 33 in the receptacle members 117A, 117B so that the receptacle members define the maximum volume of the pump cell 17. The vacuum drawn has the effect of pulling the upper and lower shell halves 33A, 33B together as the pump cell 17 is filled. This increases the accuracy of the pump 11 because the volume defined by the receptacle members 117A, 117B formed within the rigid shell 33 is highly accurate and repeatable. When the shell halves 33A, 33B are drawn together so that spacing and hence the volume defined by the receptacle members 117A, 117B is always precisely the same.

Figure 8B:
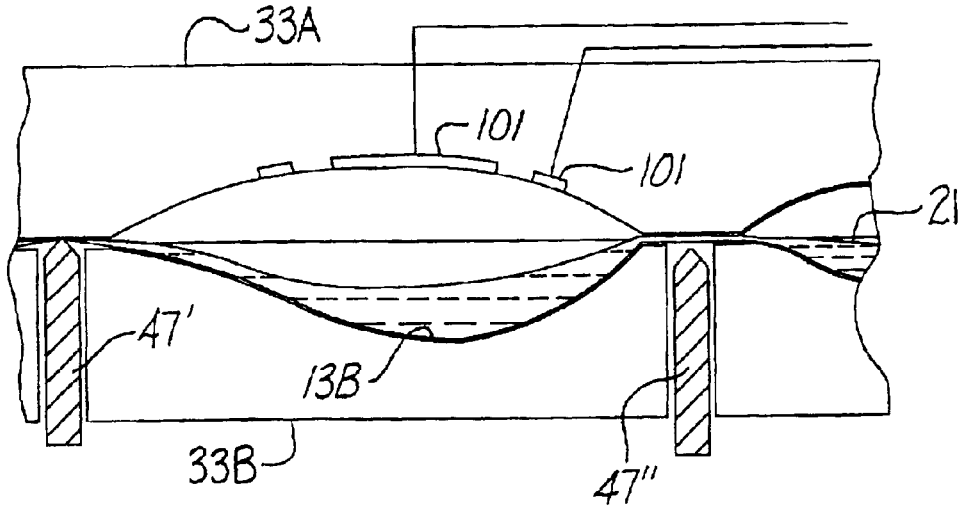
Figure 8C:
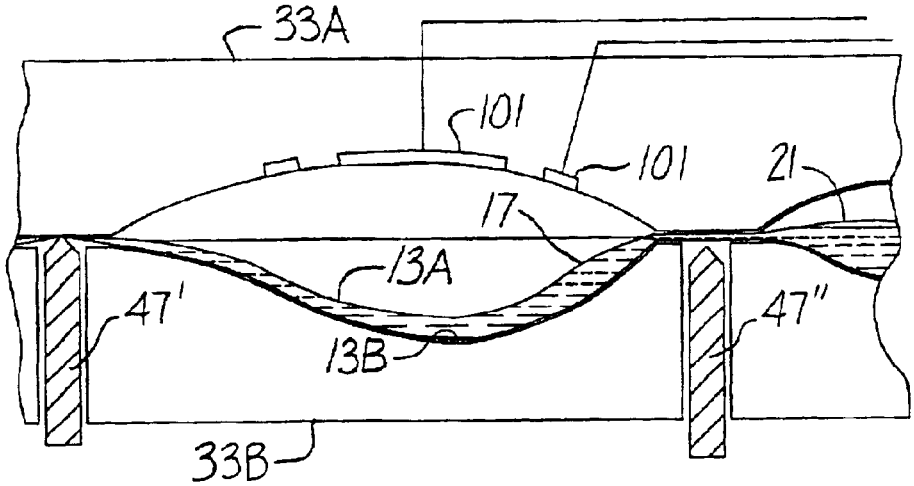
Figure 8D:
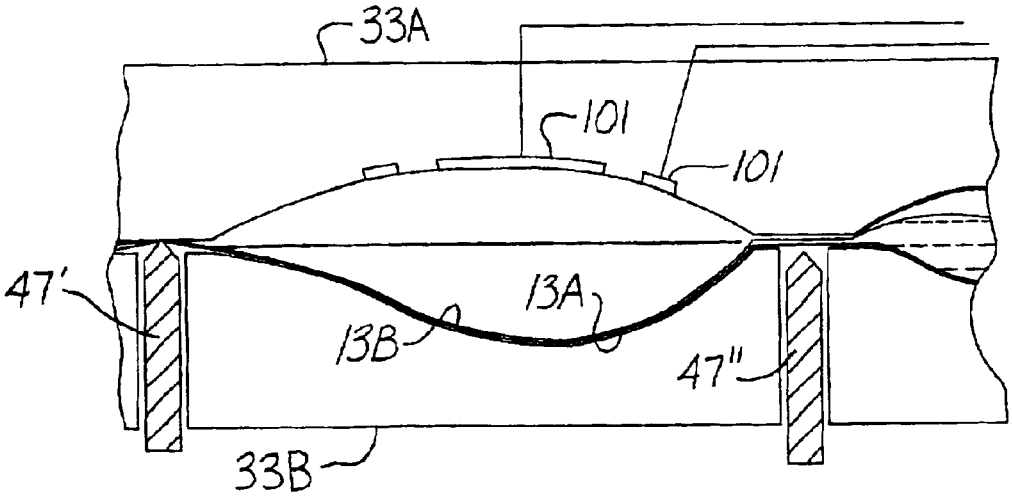

After the pump cell is filled, the pinch valve 47' is closed and the pinch valve 47" is opened. A vacuum is maintained on the pump cell 17 in the receptacle member 117B in the lower shell half 33B, while the valve 63 is operated to expose the receptacle member on the upper shell half 33A to a positive pressure from the pressure source 65. As a result the bottom wall 13B of the liner 13 remains substantially conformed against the shell 33 in the lower shell half receptacle member 117B. The top wall 13A collapses against the lower wall 13B to discharge the liquid from the pump cell 17. This discharge process is illustrated in FIGS. 8B–8D. By maintaining the lower wall 13B in contact with the shell 33 to discharge, the material of the liner 13 is held without wrinkles, which can affect the actual volume in the pump cell 17 and reduce accuracy. The overall operation of the pump 11 is the same for each pump cell 17 (the manifold pump cells 19, header pump cell 21 and passages 27 also operate in the same way). However, the sequence of operation of the valves (47', 47", 63, 67) can be selected to achieve the specific function needed for the pump 11.

A sequence of operation of the single pump cell 17 is illustrated in FIGS. 8A–8D. These figures show the pump cell 17 as being equipped with capacitance-type liquid level sensors 101. An example of a suitable sensor would be a QProx capacitive sensor available from Quantum Research Group Ltd. of Southampton, England. Sensors of this type operate by detection of the liquid mass, rather than direct detection of volume. These sensors 101 are mounted in the upper shell half 33A at the top of the receptacle member 117A and are connected to a pump master control 103 (FIG. 2). Other types of sensors (not shown), such as optical or ultrasonic sensors, could be mounted on the shell 33 for detecting the fill state of the pump cell 17. The sensors 101 are capable of detecting the separation of the liquid from the top of the receptacle member 117A. This permits the control 103 to calculate the precise, instantaneous volume of the pump cell 17. The sensors 101 may be used to operate the valves 47', 47" by detection of when the pump cell 17 is completely full or completely empty. Moreover, the sensor 101 can detect a blockage in the pump cell 17. However it is envision that by knowing the instantaneous volume of liquid in the pump cell 17 during discharge, the valves 47" may also be actuated to close off the pump cell 17 for delivery of partial volumes. In other words, the valve 47" could be actuated at a point during the discharge, such as shown in FIGS. 8B or 8C, to prevent further liquid from leaving the pump cell 17.

The operation of a single pump cell of a pump 211 of a second embodiment is shown in FIGS. 9A–9D for use in delivering precise incremental volumes of liquid. Corresponding parts of the pump 211 of the second embodiment will be designated by the same reference numerals as the pump 11 of the first embodiment, with the prefix "2". A pair of pinch valves (247A, 247B) on the outlet side of the pump cell 217 are capable of segregating a very small, discrete volume of the pump cell for delivering this small, discrete volume. It will be appreciated that if a pump cell has a very small maximum volume, it will be possible to deliver a very precise volume from the pump cell (even where the pump cell is fully emptied with each cycle of operation of the pump). However, delivery of such small volumes will require many cycles of operation to achieve the total volume of liquid needed. The pump 211 of FIGS. 9A–9D allows a full volume of the pump cell 217 to be discharged until the precise total volume is neared, at which time the valves 247A, 247B are operable to permit a partial volume to be discharged until the total volume is reached. The valves 247A, 247B include wedges 253A, 253B which are in the illustrated embodiment, slidingly connected to each other, such as by a dovetail connection. In full volume discharge operation of the pump cell 217, the valve 247A moves up to pinch off the outlet side of the pump cell and down to permit liquid to be discharged from the pump cell. The valve 247B is not used.

Figure 9A:
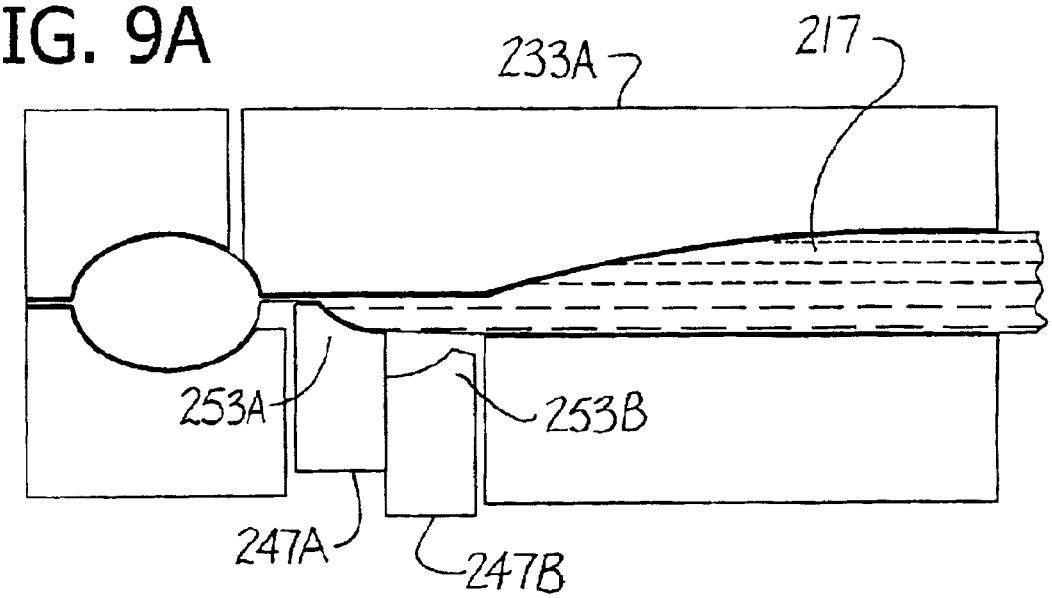
FIGS. 9A–9D are fragmentary cross sections of a pump of a second embodiment illustrating its operation.
Figure 9B:
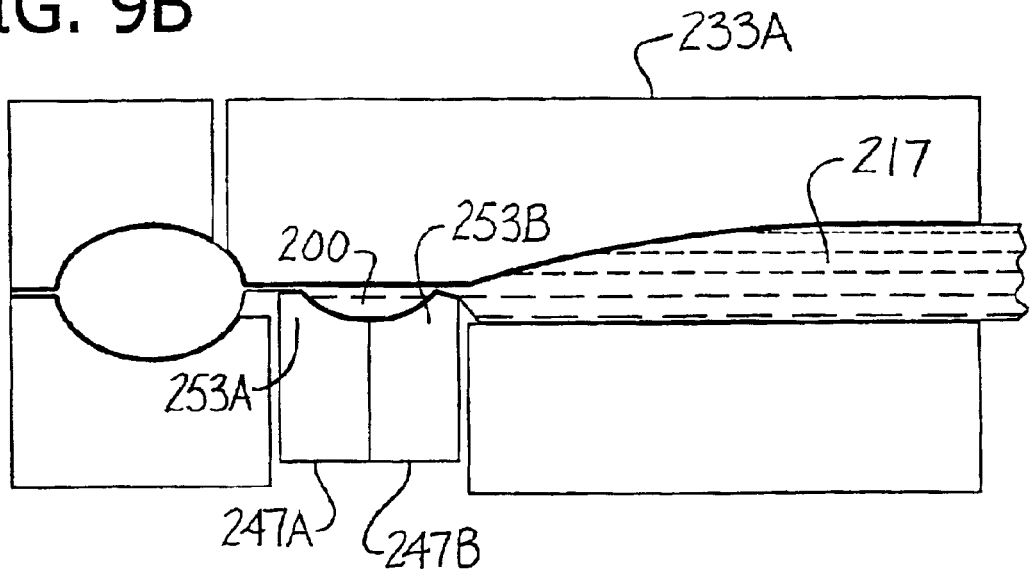
Figure 9C:
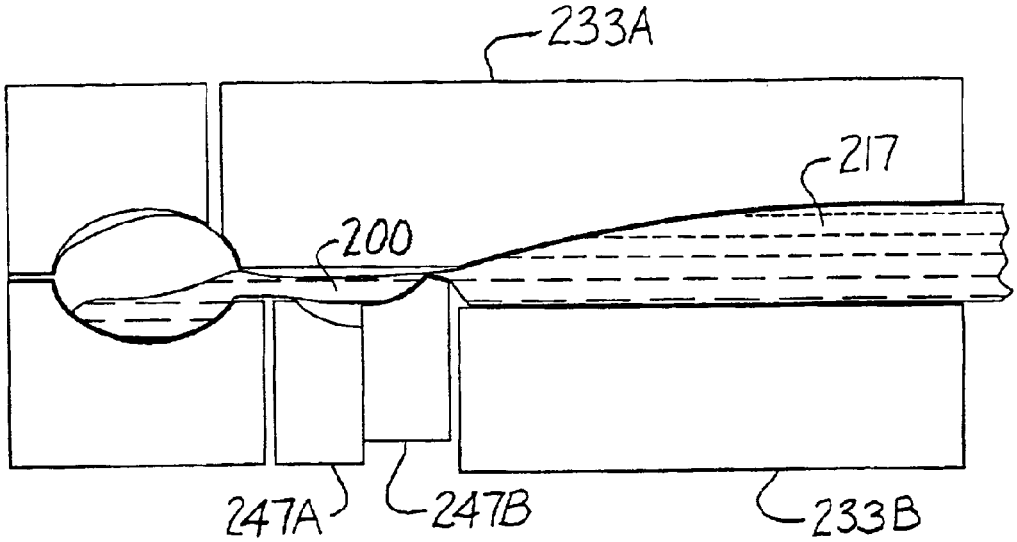
Figure 9D:
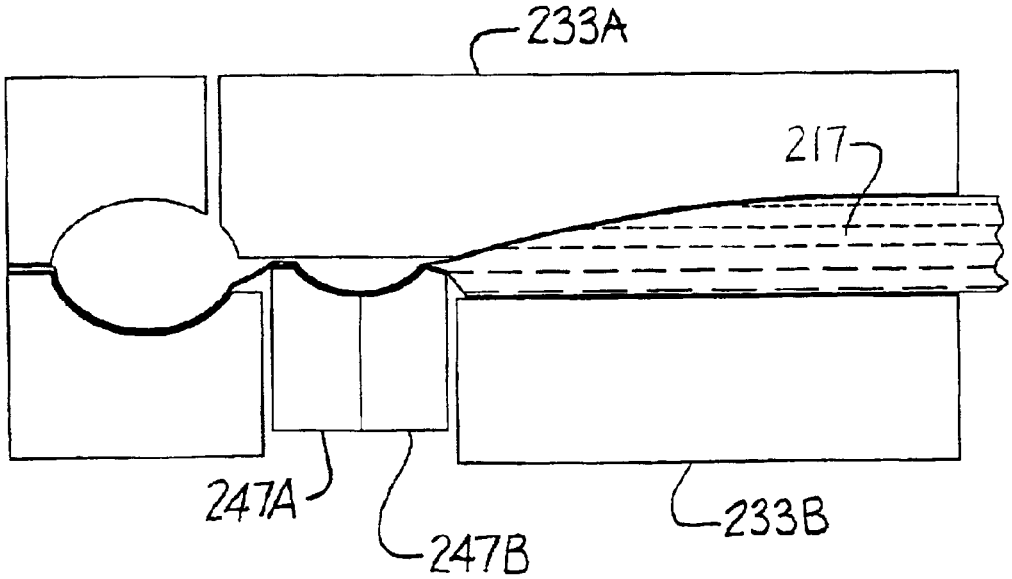

The operation of the pump 211 for the pump cell 217 to deliver a partial volume is shown in FIGS. 9A–9D. In this embodiment, it is not necessary to detect instantaneous volumes or to time the closure of pinch valves to discharge a partial volume. In each cycle, the full volume of the pump cell or segregated portion of the pump cell is discharged. Initially, valve 247A is actuated to pinch off the outlet of the pump cell 217 and the entire pump cell is filled by application of a vacuum pressure to the pump cell (FIG. 9A). The valve 247B is actuated to pinch off the pump cell 217 just upstream of the outlet (FIG. 9B). It may be seen that the valve wedges 253A, 253B are shaped so as to define a small volume 200 in an outlet end region of the pump cell 217. The valve 247A is opened and pressure is applied to the pump cell 217 so that liquid is discharged from the small volume 200 is the only liquid discharged from the cell (FIG. 9C). The valve 2478 holds the liquid in the remainder of the cell 217 from leaving the cell. Eventually, the small volume 200 is emptied (FIG. 9D) and the pump 211 is ready to repeat the operation or to return to discharging the full volume of the pump cell 217.

Having described the base operation (and one variant) of the pump 11 (211) for a single pump cell 17 (217), we will now discuss the operation of the pump 11 formed for using the specific liner 13 shown in FIGS. 4 and 5, with particular reference being made to FIG. 5. The pinch valves 47 mounted in the upper shell half 33A are shown in phantom. In a preferred embodiment, the pump 11 applies a vacuum to all of the pump cells 17, manifold pump cells 19, header pump cell 21 and passages 27 at the same time. Similarly, any air pressure applied in a discharge operation would be applied to all of the aforementioned components at the same time. While it would be possible to apply a vacuum or positive pressure to the various components individually, the arrangement would be more complex and costly. The pinch valves 47 can be used as needed to isolate or block off one or more of the cells (17, 19, 21) or passages (27) not to be filled with or emptied of liquid.

Operation will be described with reference to one of the groups 29 of pump cells 17 and manifold pump cells 19, the operation of the others being substantially the same. The passages 27 are connected to one or more liquid sources (not shown) at the inlets 25 for admitting the liquid into the pump 11. To draw liquid into the passages 27, valves 63, 69 are opened to apply a vacuum to the entire shell 33 and specifically to the passage receptacles 127A, 127B. The pinch valves 47 at the inner ends of the passages 27 are closed so that liquid is drawn into the fingers, but passes no further in this cycle of operation of the pump 11. Preferably, each of the passages 27 has suitable fill sensors, such as the capacitive liquid level sensors 101 shown in FIGS. 8A–8D. Such sensors would be capable of detecting that a particular one of the passages 27 had not filled in the cycle. In response, an indication may be given that one of the liquid sources is empty or that a blockage is present. Before the liquid source is replaced or immediately after the blockage is removed, the pump 11 is actuated to collapse the one passage 27 so that any liquid and air in the passage is expelled back into the inlet 25 and the liquid source. All of the pinch valves 47 except the one at the inlet 25 of the one passage 27 will have been closed so that the pump 11 does not otherwise operate to pump the liquid even though pressure and vacuum is applied to all of the cells (17, 19, 21) and the passages 27. In this way, the inlet 25, and any delivery tube (not shown) connecting the inlet to the liquid source, is re-primed so that after replacement of the liquid source (or removal of the blockage) the one passage 27 will not be again partially filled with air. The pump 11 is made to recycle with the pinch valves 47, save the pinch valve connecting the one passage 27 to the liquid source, in the same manner to fill the one passage. The pump 11 then returns to normal operation. It will be appreciated that closely similar kinds of detection and remedy could be applied for the cells (17, 19 and 21) fitted with liquid level sensors. The need for such detection varies with the particular application of the pump 11. The passages 27 generally have an elongate, curved shape which facilitates the expulsion or "scavenging" of liquid from the passages, which increases the accuracy of the pump 11.

All of the passages 27 communicate with the manifold pump cell 19 of the group 29. The other three pump cells 17 are all connected to the manifold pump cell 19 and the manifold pump cell has an outlet opening directly into the header pump cell 21. Thus, it will be understood that the manifold pump cell 19 can operate just like a standard pump cell 17 described previously, by receiving liquid and discharging the liquid into the header cell 21 without involving any of the other pump cells. If the passages 27 are connected to sources containing a different liquids, the manifold pump cell 19 also becomes a pre-mixing chamber prior to any mixing which may occur in the header pump cell 21.

The manifold pump cell 19 and the pump cells 17 in the group 29 have different sizes preferably selected to give flexibility in discharging the precise amounts needed in a particular application. Each of the pump cells 17 can be filled with liquid from the manifold pump cell 19 by opening the pinch valve 47 leading to that particular pump cell, applying a vacuum to both receptacle members 117A, 117B, and to the manifold pump cell via the receptacle members 119A, 119B. The manifold pump cell 19 and at least some of the passages 27 remain in fluid communication with the liquid source(s) so that they refill with liquid at the same time the pump cell(s) 17 is filled. The pump 11 can be operated to discharge from the manifold pump cell 19 into any one or any selected set of the pump cells 17 in the group 29. This is accomplished by closing the pinch valves 47 leading to the pump cells 17 not to be filled. The control 103 is operable to select the pump cells 17 in the group 29 (including the manifold pump cell 19 which also can discharge directly into the header pump cell 21) to be used in order to achieve the volume of the particular liquid needed in the fewest number of cycles of operation. Again, this is carried out by opening and closing the particular pinch valves 49. The pump cells 17 are capable of discharging into the header pump cell 21 by substantially the same operation The flexibility in operation of the individual pinch valves depends upon the precision as well as the variations in liquid volume and composition which is required for a particular application.

The pump 11 of the present invention has application in various systems, including compounding or mixing systems, such as the drink dispenser 23 shown in FIG. 1. The dispenser has a selected number (three in the illustrated embodiment) of reservoirs 104 of drink flavorings, each of which is connected by a respective line 105 to the pump 11 of the present invention for dispensing to a container C. The internal construction of the pump 11 would be different than shown in FIGS. 4 and 5, requiring fewer pump cells, but having the same general components. The pump 11 is configured so that the flavorings can be intermixed in the pump (such as in a header pump cell) prior to discharge from the pump. The pump 109 shown diagrammatically in FIG. 1 would also have the pressure source and vacuum source, such as is shown at 65 and 71 in FIG. 2, for full operation. A discharge line 106 is connected to the pump outlet and also to a mixing chamber 107 which receives a base liquid (e.g., carbonated water) from a base liquid reservoir 108. As shown, the base liquid reservoir has its own pump 109 for feeding the base liquid to the mixing chamber 107. The pump 109 may have a similar or substantially different construction than the pump 11 of the present invention.

Notably, it is possible to keep the pump 11 clean with a minimum of labor. The line connections from the flavoring reservoirs 104 can be disconnected and the pump shell 33 can be opened to expose the liner 13. The liner can be simply removed and replaced with a fresh liner. Preferably the discharge line 106 is formed as part of the liner 13 so that it is simultaneously replaced. As can be seen, it is not necessary to use any detergents or other cleaning chemicals or implements. No flushing of the pump 11 is required. It will be understood that the drink dispenser 23 is but one application in which a pump of the present invention is useful. The pump is envisioned as being useful in any application in which it will be necessary to frequently clean the pump, or in which small, relatively precise quantities are to be metered by the pump.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A pump for pumping a fluent material comprising:

a liner including opposing walls of flexible material defining a plurality of pump cells, an inlet and an outlet, the pump cells being sized and shaped for receiving a quantity of the fluent material and being expandable for receiving fluent material and contractible for discharging fluent material;

a rigid shell adapted to receive and substantially enclose at least the pump cells of the liner, the shell being formed with a plurality of receptacles therein to receive in close fitting relation the pump cells, said receptacles being adapted for connection to a source of pressurized gas and for connection to a vacuum source for selectively applying a vacuum pressure and a positive pressure to the cells to selectively expand and collapse the cells for drawing fluent material into the pump cell and expelling the fluent material from the pump cells;

valves associated with the rigid shell and disposed for pinching engagement with the liner adjacent to the pump cells for selectively blocking and opening fluid communication of the pump cells thereby to pump the fluent material.

2. A pump as set forth in claim 1 wherein at least some of the pump cells are sized for receiving different quantities of fluent material.

3. A pump as set forth in claim 2 wherein at least some of the receptacles are sized differently in correspondence with the differently sized pump cells, each receptacle having a volume selected to define the maximum volume of the corresponding pump cell.

4. A pump as set forth in claim 3 wherein the walls of the liner further define a manifold pump cell disposed between the inlet and at least some of the pump cells, the manifold pump cell being adapted for fluid communication with the inlet and said at least some pump cells, the manifold pump cell being expandible and contractible for receiving fluent material from the inlet and for selectively delivering fluent material to said at least some pump cells.

5. A pump as set forth in claim 4 wherein the walls of the liner further define a header pump cell adapted for fluid communication with said at least some pump cells for receiving fluent material discharged from said pump cells, the header pump cell being expandable and contractible for receiving fluent material from the pump cells and discharging a mixture of said fluent materials.

6. A pump as set forth in claim 5 wherein the walls of the liner further define passages between the inlet and the manifold pump cell, the passages being expandible and contractible for receiving fluent material from the inlet and for selectively delivering fluent material to the manifold pump cell.

7. A pump as set forth in claim 1 wherein the liner walls are joined together to define the pump cells.

8. A pump as set forth in claim 1 wherein the walls of the liner further define a manifold pump cell disposed between the inlet and at least some of the pump cells, the manifold pump cell being adapted for fluid communication with the inlet and said at least some pump cells, the manifold pump cell being expandible and contractible for receiving fluent material from the inlet and for selectively delivering fluent material to said at least some pump cells.

9. A pump as set forth in claim 2 wherein the walls of the liner further define a header pump cell adapted for fluid communication with said at least some pump cells for receiving fluent material discharged from said pump cells, the header pump cell being expandable and contractible for receiving fluent material from the pump cells and discharging a mixture of said fluent material.

10. A pump as set forth in claim 1 in combination with the pressure source and the vacuum source.

11. A pump for pumping a fluent material comprising:

a liner including opposing walls of flexible material defining at least one pump cell, an inlet and an outlet, the pump cell being sized and shaped far receiving a quantity of the fluent material and being expandable for receiving fluent material and contractible for discharging fluent material;

a rigid shell adapted to receive and substantially enclose at least the pump cell of the liner, the shell being formed with at least one receptacle therein to receive in close fitting relation the pump cell, said one receptacle being adapted for connection to a source of pressurized gas and for connection to a vacuum source for selectively applying a vacuum pressure and a positive pressure to the cell to selectively expand and collapse the cell for drawing fluent material into the pump cell and expelling the fluent material from the pump cell;

the rigid shell being adapted to hold the walls of the liner in sealing relation around the receptacle, valves associated with the rigid shell and disposed for pinching engagement with the liner adjacent to the pump cell for selectively blocking and opening fluid communication of the pump cell thereby to pump the fluent material.

12. A pump as set forth in claim 11 wherein the walls of the liner are free of fixed connection inwardly of a peripheral edge margin of the liner.

13. A pump for pumping a fluent material comprising:

a liner including opposing walls of flexible material defining at least one pump cell, an inlet and an outlet, the pump cell being sized and shaped for receiving a quantity of the fluent material and being expandable for receiving fluent material and contractible for discharging fluent material;

a rigid shell adapted to receive and substantially enclose at least the pump cell of the liner, the shell being formed with at least one receptacle therein to receive in close fitting relation the pump cell, said one receptacle being adapted for connection to a source of pressurized gas and for connection to a vacuum source for selectively applying a vacuum pressure and a positive pressure to the cell to selectively expand and collapse the cell for drawing fluent material into the pump cell and expelling the fluent material from the pump cell;

the shell comprising first and second shell members hingedly attached to each other for opening and closing the shell to receive or remove the liner from the shell, valves associated with the rigid shell and disposed for pinching engagement with the liner adjacent to the pump cell for selectively blocking and opening fluid communication of the pump cell thereby to pump the fluent material.

14. A pump as set forth in claim 13 wherein the receptacle comprises a first receptacle member defined in the first shell member and a second receptacle member defined in the second shell member.

15. A pump as set forth in claim 13 wherein the liner as received in the shell is disposed between the shell and any fluent material entering the shell whereby, in use, the shell is free of contact with the fluent material.

16. Apparatus for dispensing a customized drink mixture comprising:

a dispensing outlet for dispensing the drink mixture to a container;

a first pump for pumping a base liquid of the drink mixture from a source to the dispensing outlet;

a second pump for metering selected quantities of admixtures to the base liquid for forming with the base liquid the drink mixture in the container, the second pump comprising:

a liner including opposing walls of flexible material selectively joined together to define at least two pump cells sized and shaped for receiving a quantity of one of the admixtures, the liner further including inlets and at least one outlet in communication with the pump cell so that admixture passes through the pump contacting only the liner;

a rigid shell adapted to receive and substantially enclose at least the pump cells of the liner, the shell being formed with receptacles therein to receive in close fitting relation the pump cells, the receptacles being adapted for connection to a source of pressurized gas and for connection to a vacuum source for selectively applying a vacuum pressure and a positive pressure to the cell to selectively expand and collapse the cell for drawing fluent material into the pump cell and expelling the fluent material from the pump cell;

valves associated with the rigid shell and disposed for pinching engagement with the liner adjacent to the pump cells for selectively blocking and opening fluid communication of the pump cells with the inlets and the outlet thereby to pump the admixture.

17. Apparatus as set forth in claim 16 wherein the liner is adapted to be removably received in the shell for disposal and replacement of the liner.

18. Apparatus as set forth in claim 17 wherein the shell has an open a position for receiving and removing the pump cell from the shell and a closed position in which the pump cell is substantially enclosed in the shell.

19. Apparatus as set forth in claim 16 wherein the pump cell as received in the shell is the only part of the pump arranged for contact with the fluent material.

20. Apparatus as set forth in claim 16 wherein the liner walls are joined together to define the pump cells.

21. Apparatus as set forth in claim 16 wherein the walls of the liner are held together in sealing relation around each receptacle by the shell.

22. Apparatus as set forth in claim 16 wherein the shell comprises first and second shell members movable for opening and closing the shell to receive or remove the liner from the shell.

23. Apparatus as set forth in claim 22 wherein each receptacle comprises a first receptacle member defined in the first shell member and a second receptacle member defined in the second shell member.

24. A pump for metering a fluent material comprising:

a pump cell having flexible walls expandable between a fill configuration in which the walls enclose a first volume for receiving fluent material into the pump cell and a discharge configuration in which the walls enclose substantially no volume for discharging fluent material from the pump cell;

a shell defining a space therein adapted to receive the pump cell for substantially enclosing the pump shell;

a pressure source adapted for fluid communication with the shell space for applying positive fluid pressure in the space;

a vacuum source adapted for fluid communication with the shell space for applying vacuum pressure to the shell space;

a control for the pressure source and the vacuum source operable to first apply a vacuum pressure to the shell space for expanding the pump cell to the fill configuration for receiving fluent material into the pump cell, then to apply both a vacuum pressure and a positive fluid pressure for drawing one of the walls of the pump cell against the shell and pressing another of the walls of the pump cell against said one wall for moving the pump cell to the discharge configuration for discharging the fluent material.

25. A pump as set forth in claim 24 wherein the pump cell is adapted to be removably received in the shell for disposal and replacement of the liner.

26. A pump as set forth in claim 25 wherein the shell has an open position for receiving and removing the pump cell from the shell and a closed position in which the pump cell is substantially enclosed in the shell.

27. A pump as set forth in claim 24 wherein the pump cell as received in the shell is the only part of the pump arranged for contact with the fluent material.

28. A pump as set forth in claim 24 further comprising multiple pump cells.

29. A pump as set forth in claim 28 wherein the shell is formed with a receptacle for each pump cell, the receptacle defining the space adapted to receive and substantially enclose a corresponding pump cell.

30. A pump as set forth in claim 28 wherein the shell comprises first and second shell members movable for opening and closing the shell to receive or remove the pump cells from the shell.

31. A pump as set forth in claim 30 wherein each receptacle comprises a first receptacle member defined in the first shell member and a second receptacle member defined in the second shell member.

32. A method of operating a pump including a flexible pump cell expandable to define a volume and contractible to collapse the volume, the method comprising the steps of:

receiving fluent material into the pump cell by creating a vacuum around the pump cell to expand the pump cell;

discharging fluent material from the pump cell by applying a vacuum pressure generally on one side of the pump cell while applying positive pressure to another side of the pump cell for collapsing said other side of the pump cell against said one side to discharge fluent material from the pump cell.

33. A method as set forth in claim 32 further comprising limiting expansion of the pump cell upon said step of creating a vacuum by providing a rigid receptacle receiving at least a portion of the pump cell and engageable with the pump cell upon expansion thereof to define the maximum volume enclosed by the pump cell.

34. A method as set forth in claim 32 further comprising the steps of monitoring the volume of fluent material in the pump cell and selectively closing off the pump cell based upon the monitored amount of fluent material in the pump cell prior to complete evacuation of the pump cell for delivering a partial volume of fluent material from the pump.

35. A method as set forth in claim 32 further comprising isolating a portion of the pump cell prior to said step of discharging fluent material thereby to deliver a partial volume of fluent material from the pump cell.

36. A method as set forth in claim 32 further comprising the steps of monitoring the volume of fluent material in the pump cell, providing an indication when the pump cell is fully expanded but not filled with fluent material, discharging the fluent material from the pump cell in the direction the fluent material entered the pump cell and receiving fluent material again into the pump cell by applying a vacuum pressure around the pump cell.

37. A method as set forth in claim 32 wherein the pump includes multiple expandible and contractible pump cells of different sizes and wherein the method further comprises the step of admitting fluent material only into pump cells selected for delivering a discrete volume upon said discharging step, at least one pump cell being blocked from receiving fluent material upon expansion thereof.

38. A disposable pump liner for use in a rigid shell of a pump, the shell being adapted to receive the liner to meter fluent material without contact of the fluent material with the shell, the pump liner comprising opposed flexible walls constructed for removable reception in the shell, an outlet for discharging fluent material from the liner, a plurality of pump cell defined by the opposed flexible walls, each pump cell being deflectable to a first position defining a first volume for receiving fluent material therein and to a second position defining a second volume less than said first volume by action of a fluid on said cell outside said opposed flexible walls for pumping fluent material from said cell towards the outlet, said plurality of pump cells including at least two pump cells having different volumes for use in pumping different selected volumes of fluent material toward the outlet.

39. A disposable pump liner as set forth in claim 38 wherein the liner is formed with plural pump cells.

40. A disposable pump liner as set forth in claim 39 wherein the liner walls are joined together to define the pump cells.

41. A disposable pump liner as set forth in claim 40 wherein the liner includes locators for locating the liner within the rigid shell.

42. A disposable pump liner as set forth in claim 41 wherein the locators comprises holes arranged in the liner in correspondence with the location of studs on the rigid shell which are received into the holes for location of the liner on the shell.

43. A disposable pump liner as set forth in claim 38 wherein the pump cells include a header pump cell, said two cells being adapted to pump material into the header pump cell.

44. A disposable pump liner as set forth in claim 43 wherein the pump cells include at least two groups of pump cells, each group including at least two pump cells of differing volumes, the pump cells of each group being adapted to pump fluent material into the header pump cell.

45. Compounding apparatus for selectively combining components and dispensing admixtures, the compounding apparatus comprising:

a liner of including opposing walls of flexible material at least partially free of connection to permit motion toward and away from each other, the liner including an inlet for each component to be compounded and at least one outlet;

a shell having multiple receptacles formed therein, the shell being adapted to receive the liner with portions of the liner in registration with corresponding receptacles, the wall portions in registration with the receptacles defining pump cells, the wall portions of each pump cell being expandable to receive a volume of at least one of the components into the pump cell and collapsible to discharge the component from the pump cell;

a pressure control system in fluid communication with the receptacles to selectively affect fluid pressure in the receptacle around the pump cells to cause expansion and contraction of the pump cells for receiving and discharging the components to form the admixture.

46. Compounding apparatus as set forth in claim 45 wherein at least some of the receptacles and pump cells defined therein are of different sizes when expanded for holding different volumes of the components for use in selecting the amount of one of the components in the admixture.

47. Compounding apparatus as set forth in claim 46 wherein the receptacles and pump cells having different sizes are grouped in sets arranged for providing different selected total volumes of discharged component by cooperative action of pump cells in the set.

48. Compounding apparatus as set forth in claim 47 wherein one of the pump cells constituting a manifold pump cell is arranged for selectively discharging into multiple other pump cells of different sizes for metering the volume discharged from the pump.

49. Compounding apparatus as set forth in claim 47 wherein at least some of the pump cells are arranged for discharging components into another of the pump cells constituting a header pump cell whereby components from said pump cells are mixed in the header pump cell prior to discharging from the pump.

50. A pump for metering a fluent material comprising:

a pump cell having flexible walls expandable between a fill configuration in which the walls enclose a first volume for receiving fluent material into the pump cell and a discharge configuration in which the walls enclose a second volume less than the first volume for discharging fluent material from the pump cell;

a shell defining a space therein adapted to receive the pump cell for substantially enclosing the pump cell;

a pressure source adapted for fluid communication with the shell space for applying positive fluid pressure in the space;

a vacuum source adapted for fluid communication with the shell space for applying vacuum pressure to the shell space;

a control for the pressure source and the vacuum source operable to first apply a vacuum pressure to the shell space for expanding the pump cell to the fill configuration for receiving fluent material into the pump cell, then to apply both a vacuum pressure and a positive fluid pressure for drawing one of the walls of the pump cell against the shell and pressing another of the walls of the pump cell toward said one wall for moving the pump cell to the discharge configuration for discharging the fluent material.

51. A pump as set forth in claim 50 wherein the pump cell is adapted to be removably received in the shell for disposal and replacement of the liner.

52. A pump as set forth in claim 50 wherein the pump cell as received in the shell is the only part of the pump arranged for contact with the fluent material.

53. A pump as set forth in claim 50 further comprising multiple pump cells.

54. A pump as set forth in claim 53 wherein the shell is formed with a receptacle for each pump cell, the receptacle defining the space adapted to receive and substantially enclose a corresponding pump cell.

55. A pump as set forth in claim 53 wherein the shell comprises first and second shell members movable for opening and closing the shell to receive or remove the pump cells from the shell.

56. A pump as set forth in claim 55 wherein each receptacle comprises a first receptacle member defined in the first shell member and a second receptacle member defined in the second shell member.

57. A pump for metering a fluent material using a pump cell having flexible walls expandable between a fill configuration in which the walls enclose a first volume for receiving fluent material into the pump cell and a discharge configuration in which the walls enclose a second volume less than the first volume for discharging fluent material from the pump cell, the pump comprising:

a shell defining a space therein adapted to receive the pump cell for substantially enclosing the pump cell;

a pressure source adapted for fluid communication with the shell space for applying positive fluid pressure in the space;

a vacuum source adapted for fluid communication with the shell space for applying vacuum pressure to the shell space;

a control for the pressure source and the vacuum source operable to first apply a vacuum pressure to the shell space for expanding the pump cell to the fill configuration for receiving fluent material into the pump cell, then to apply both a vacuum pressure and a positive fluid pressure for drawing one of the walls of the pump cell against the shell and pressing another of the walls of the pump cell toward said one wall for moving the pump cell to the discharge configuration for discharging the fluent material.

58. A pump as set forth in claim 57 wherein the shell has an open position for receiving and removing the pump cell from the cell and a closed position in which the pump cell is substantially enclosed in the shell.

59. A pump as set forth in claim 58 wherein the shell is formed with multiple receptacles, the receptacle defining the space adapted to receive and substantially enclose a corresponding pump cell of a liner have multiple pump cells.

60. A pump as set forth in claim 58 wherein the shell comprises first and second shell members movable for opening and closing the shell to receive or remove the pump cells from the shell.

61. A pump as set forth in claim 60 wherein each receptacle comprises a first receptacle member defined in the first shell member and a second receptacle member defined in the second shell member.

62. Compounding apparatus for selectively combining components and dispensing admixtures, the compounding apparatus comprising:

a liner of including opposing walls of flexible material at least partially free of connection to permit motion toward and away from each other, the liner including at least one outlet;

a shell having multiple receptacles formed therein, the shell being adapted to receive the liner with portions of the liner in registration with corresponding receptacles, the wall portions in registration with the receptacles defining pump cells, the wall portions of each pump cell being expandable to receive a volume of at least one of the components into the pump cell and collapsible to discharge the component from the pump cell;

a pressure control system in fluid communication with the receptacles to selectively affect fluid pressure in the receptacle around the pump cells to cause expansion and contraction of the pump cells for receiving and discharging the components to form the admixture.

63. A compounding apparatus as set forth in claim 62 wherein the liner is formed such that at least two of the pump cells are capable of fluid communication within the liner with another of the pump cells.

64. Compounding apparatus as set forth in claim 62 wherein at least some of the receptacles and pump cells defined therein are of different sizes when expanded for holding different volumes of the components for use in selecting the amount of one of the components in the admixture.

65. Compounding apparatus as set forth in claim 64 wherein the receptacles and pump cells having different sizes are grouped in sets arranged for providing different selected total volumes of discharged component by cooperative action of pump cells in the set.

66. Compounding apparatus as set forth in claim 65 wherein one of the pump cells constituting a manifold pump cell is arranged for selectively discharging into multiple other pump cells of different sizes for metering the volume discharged from the pump.

67. Compounding apparatus as set forth in claim 65 wherein at least some of the pump cells are arranged for discharging components into another of the pump cells constituting a header pump cell whereby components from said pump cells are mixed in the header pump cell prior to discharging from the pump.

68. Compounding apparatus for selectively combining components and dispensing admixtures using a liner of including opposing walls of flexible material at least partially free of connection to permit motion toward and away from each other, the liner including at least one outlet, the compounding apparatus comprising:

a shell having multiple receptacles formed therein, the shell being adapted to receive the liner with portions of the liner in registration with corresponding receptacles, the wall portions in registration with the receptacles defining pump cells, the wall portions of each pump cell being expandable to receive a volume of at least one of the components into the pump cell and collapsible to discharge the component from the pump cell;

a pressure control system in fluid communication with the receptacles to selectively affect fluid pressure in the receptacle around the pump cells to cause expansion and contraction of the pump cells for receiving and discharging the components to form the admixture.

69. Compounding apparatus as set forth in claim 68 wherein at least some of the receptacles are of different sizes for holding different volumes of the components in the pump cells for use in selecting the amount of one of the components in the admixture.

70. Compounding apparatus as set forth in claim 69 wherein the receptacles having different sizes are grouped in sets arranged for providing different selected total volumes of discharged component by cooperative action of pump cells in receptacles in the set.

71. A pump for pumping a fluent material comprising:

a liner including opposing walls of flexible material defining a plurality of pump cells, the pump cells being sized and shaped for receiving a quantity of the fluent material and being expandable for receiving fluent material and contractible for discharging fluent material;

a rigid shell adapted to receive and substantially enclose at least the pump cells of the liner, the shell being formed with a plurality of receptacles therein to receive in close fitting relation the pump cells, said receptacles being adapted for connection to a source of pressurized gas and for connection to a vacuum source for selectively applying a vacuum pressure and a positive pressure to the cells to selectively expand and collapse the cells for drawing fluent material into the pump cells and expelling the fluent material from the pump cells;

valves associated with the rigid shell and disposed for pinching engagement with the liner adjacent to the pump cells for selectively blocking and opening fluid communication of the pump cells thereby to pump the fluent material.

72. A pump as set forth in claim 71 wherein at least some of the pump cells are sized for receiving different quantities of fluent material.

73. A pump as set forth in claim 72 wherein at least some of the receptacles are sized differently in correspondence with the differently sized pump cells, each receptacle having a volume selected to define the maximum volume of the corresponding pump cell.

74. A pump as set forth in claim 73 wherein the walls of the liner further define a manifold pump cell disposed between the inlet and at least some of the pump cells, the manifold pump cell being adapted for fluid communication with the inlet and said at least some pump cells, the manifold pump cell being expandible and contractible for receiving fluent material from the inlet and for selectively delivering fluent material to said at least some pump cells.

75. A pump as set forth in claim 74 wherein the walls of the liner further define a header pump cell adapted for fluid communication with said at least some pump cells for receiving fluent material discharged from said pump cells, the header pump cell being expandable and contractible for receiving fluent material from the pump cells and discharging a mixture of said fluent materials.

76. A pump as set forth in claim 75 wherein the walls of the liner further define passages between the inlet and the manifold pump cell, the passages being expandible and contractible for receiving fluent material from the inlet and for selectively delivering fluent material to the manifold pump cell.

77. A pump as set forth in claim 71 wherein the liner walls are joined together to define the pump cells.

78. A pump as set forth in claim 71 wherein the walls of the liner further define a manifold pump cell disposed between the inlet and at least some of the pump cells, the manifold pump cell being adapted for fluid communication with the inlet and said at least some pump cells, the manifold pump cell being expandible and contractible for receiving fluent material from the inlet and for selectively delivering fluent material to said at least some pump cells.

79. A pump as set forth in claim 71 wherein the walls of the liner further define a header pump cell adapted for fluid communication with said at least some pump cells for receiving fluent material discharged from said pump cells, the header pump cell being expandable and contractible for receiving fluent material from the pump cells and discharging a mixture of said fluent material.

80. A pump as set forth in claim 71 in combination with the pressure source and the vacuum source.

81. A pump as set forth in claim 80 wherein the shell has an open position for receiving and removing the pump cell from the cell and a closed position in which the pump cell is substantially enclosed in the shell.

82. A pump for pumping a fluent material comprising:

a liner including opposing walls of flexible material defining at least one pump cell, the pump cell being sized and shaped for receiving a quantity of the fluent material and being expandable for receiving fluent material and contractible for discharging fluent material;

a rigid shell adapted to receive and substantially enclose at least the pump cell of the liner, the shell being formed with at least one receptacle therein to receive in close fitting relation the pump cell, said one receptacle being adapted for connection to a source of pressurized gas and for connection to a vacuum source for selectively applying a vacuum pressure and a positive pressure to the cell to selectively expand and collapse the cell for drawing fluent material into the pump cell and expelling the fluent material from the pump cell;

the rigid shell being adapted to hold the walls of the liner in sealing relation around the receptacle;

valves associated with the rigid shell and disposed for pinching engagement with the liner adjacent to the pump cell for selectively blocking and opening fluid communication of the pump cell thereby to pump the fluent material.

83. A pump as set forth in claim 82 wherein the walls of the liner are free of fixed connection inwardly of a peripheral edge margin of the liner.

84. A pump for pumping a fluent material comprising:

a liner including opposing walls of flexible material defining at least one pump cell, the pump cell being sized and shaped for receiving a quantity of the fluent material and being expandable for receiving fluent material and contractible for discharging fluent material;

a rigid shell adapted to receive and substantially enclose at least the pump cell of the liner, the shell being formed with at least one receptacle therein to receive in close fitting relation the pump cell, said one receptacle being adapted for connection to a source of pressurized gas and for connection to a vacuum source for selectively applying a vacuum pressure and a positive pressure to the cell to selectively expand and collapse the cell for drawing fluent material into the pump cell and expelling the fluent material from the pump cell;

the shell comprising first and second shell members hingedly attached to each other for opening and closing the shell to receive or remove the liner from the shell;

valves associated with the rigid shell and disposed for pinching engagement with the liner adjacent to the pump cell for selectively blocking and opening fluid communication of the pump cell thereby to pump the fluent material.

85. A pump as set forth in claim 84 wherein the receptacle comprises a first receptacle member defined in the first shell member and a second receptacle member defined in the second shell member.

86. A pump as set forth in claim 84 wherein the liner as received in the shell is disposed between the shell and any fluent material entering the shell whereby, in use, the shell is free of contact with the fluent material.

* * * * *